US011462079B2

(12) United States Patent
Nagaragatta et al.

(10) Patent No.: US 11,462,079 B2
(45) **Date of Patent: *Oct. 4, 2022**

(54) DEVICES, SYSTEMS, AND RELATED METHODS FOR REAL-TIME MONITORING AND DISPLAY OF RELATED DATA FOR CASINO GAMING DEVICES

(71) Applicant: Shuffle Master GmbH & Co KG, Vienna (AT)

(72) Inventors: Ravi Nagaragatta, Bangalore (IN); Georg Fekete, Korneuburg (AT)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

This patent is subject to a terminal disclaimer.

(21) Appl. No.: 17/129,710

(22) Filed: Dec. 21, 2020

(65) Prior Publication Data

US 2021/0110675 A1 Apr. 15, 2021

Related U.S. Application Data

(63) Continuation of application No. 16/409,996, filed on May 13, 2019, now Pat. No. 10,885,748, which is a (Continued)

(51) Int. Cl.
*G07F 17/32* (2006.01)
*A63F 1/12* (2006.01)

(52) U.S. Cl.
CPC ..... *G07F 17/3293* (2013.01); *A63F 1/12* (2013.01); *G07F 17/322* (2013.01);

(Continued)

(58) Field of Classification Search
CPC ..... G07F 17/3293; G07F 17/3202; G07F 17/3211; G07F 17/322; G07F 17/3225; G07F 17/3234; A63F 1/12
See application file for complete search history.

(56) References Cited

U.S. PATENT DOCUMENTS 130,281 A 8/1872 Coughlin
205,030 A 6/1878 Ash (Continued)

FOREIGN PATENT DOCUMENTS

AU 2383667 A 1/1969
AU 5025479 A 3/1980

(Continued)

OTHER PUBLICATIONS

DVD Labeled "Exhibit 1". This is a DVD taken by Shuffle Master personnel of the live operation of a CARD One2Six.(Trademark). Shuffler (Oct. 7, 2003).

(Continued)

*Primary Examiner* — Kevin Y Kim
(74) *Attorney, Agent, or Firm* — TraskBritt

(57) ABSTRACT

Monitoring systems for monitoring electronic card handling devices are disclosed. A monitoring system includes a monitoring server configured to receive card handling performance data from a number of electronic card handling devices. The monitoring server is further configured to associate received performance data with a corresponding electronic card handling device. The monitoring server is further configured to display the performance data associated with at least some of the electronic card handling devices. Other related systems and methods are also disclosed.

20 Claims, 15 Drawing Sheets

Related U.S. Application Data continuation of application No. 15/276,476, filed on Sep. 26, 2016, now Pat. No. 10,339,765.

(52) U.S. Cl.
CPC ..... *G07F 17/3202* (2013.01); *G07F 17/3211* (2013.01); *G07F 17/3225* (2013.01); *G07F 17/3234* (2013.01)

(56) References Cited

U.S. PATENT DOCUMENTS 609,730 A 8/1898 Booth
673,154 A 4/1901 Bellows
793,489 A 6/1905 Williams
892,389 A 7/1908 Bellows
1,014,219 A 1/1912 Hall
1,043,109 A 11/1912 Hurm
1,157,898 A 10/1915 Perret
1,256,509 A 2/1918 Belknap
1,380,898 A 6/1921 Hall
1,556,856 A 10/1925 Lipps
1,757,553 A 5/1930 Tauschek
1,850,114 A 3/1932 McCaddin
1,885,276 A 11/1932 McKay
1,889,729 A 11/1932 Hammond
1,955,926 A 4/1934 Matthaey
1,992,085 A 2/1935 McKay
1,998,690 A 4/1935 Shepherd et al.
2,001,220 A 5/1935 Smith
2,001,918 A 5/1935 Nevus
2,016,030 A 10/1935 Woodruff et al.
2,043,343 A 6/1936 Warner
2,060,096 A 11/1936 McCoy
2,065,824 A 12/1936 Plass
2,159,958 A 5/1939 Sachs
2,185,474 A 1/1940 Nott
2,254,484 A 9/1941 Hutchins
D132,360 S 5/1942 Gardner
2,282,040 A 5/1942 Doran
2,328,153 A 8/1943 Laing
2,328,879 A 9/1943 Issacson
D139,530 S 11/1944 Schindler
2,364,413 A 12/1944 Wittel
2,525,305 A 10/1950 Lombard
2,543,522 A 2/1951 Cohen
2,588,582 A 3/1952 Sivertson
2,615,719 A 10/1952 Fonken
2,659,607 A 11/1953 Skillman et al.
2,661,215 A 12/1953 Stevens
2,676,020 A 4/1954 Ogden
2,692,777 A 10/1954 Miller
2,701,720 A 2/1955 Ogden
2,705,638 A 4/1955 Newcomb
2,711,319 A 6/1955 Morgan et al.
2,714,510 A 8/1955 Oppenlander et al.
2,717,782 A 9/1955 Droll
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Gottlieb
2,815,214 A 12/1957 Hall
2,821,399 A 1/1958 Heinoo
2,914,215 A 11/1959 Neidig
2,937,739 A 5/1960 Levy
2,950,005 A 8/1960 MacDonald
RE24,986 E 5/1961 Stephenson
3,067,885 A 12/1962 Kohler
3,107,096 A 10/1963 Osborn
3,124,674 A 3/1964 Edwards et al.
3,131,935 A 5/1964 Gronneberg
3,147,978 A 9/1964 Hjalmar
D200,652 S 3/1965 Fisk
3,185,482 A 5/1965 Russell
3,222,071 A 12/1965 Lang
3,235,741 A 2/1966 Plaisance
3,288,308 A 11/1966 Gingher
3,305,237 A 2/1967 Granius
3,312,473 A 4/1967 Friedman et al.
3,452,509 A 7/1969 Werner
3,530,968 A 9/1970 Palmer
3,588,116 A 6/1971 Kosaburo
3,589,730 A 6/1971 Slay
3,595,388 A 7/1971 Castaldi
3,597,076 A 8/1971 Hubbard et al.
3,598,396 A 8/1971 Andrews et al.
3,618,933 A 11/1971 Roggenstein et al.
3,627,331 A 12/1971 Erickson
3,666,270 A 5/1972 Mazur
3,680,853 A 8/1972 Houghton et al.
3,690,670 A 9/1972 Cassady et al.
3,704,938 A 12/1972 Fanselow
3,716,238 A 2/1973 Porter
3,751,041 A 8/1973 Seifert
3,761,079 A 9/1973 Azure
3,810,627 A 5/1974 Levy
D232,953 S 9/1974 Shigeo
3,861,261 A 1/1975 Maxey
3,897,954 A 8/1975 Erickson et al.
3,899,178 A 8/1975 Watanabe
3,909,002 A 9/1975 Levy
3,929,339 A 12/1975 Mattioli
3,944,077 A 3/1976 Green
3,944,230 A 3/1976 Fineman
3,949,219 A 4/1976 Crouse
3,968,364 A 7/1976 Miller
3,981,163 A 9/1976 Tillotson
4,023,705 A 5/1977 Reiner et al.
4,033,590 A 7/1977 Pic
4,072,930 A 2/1978 Lucero et al.
4,088,265 A 5/1978 Garczynski
4,151,410 A 4/1979 McMillan et al.
4,159,581 A 7/1979 Lichtenberg
4,162,649 A 7/1979 Thornton
4,166,615 A 9/1979 Noguchi et al.
4,232,861 A 11/1980 Maul
4,280,690 A 7/1981 Hill
4,283,709 A 8/1981 Lucero et al.
4,310,160 A 1/1982 Willette et al.
4,339,134 A 7/1982 Macheel
4,339,798 A 7/1982 Hedges et al.
4,361,393 A 11/1982 Noto
4,368,972 A 1/1983 Naramore
4,369,972 A 1/1983 Parker
4,374,309 A 2/1983 Walton
4,377,285 A 3/1983 Kadlic
4,385,827 A 5/1983 Naramore
4,388,994 A 6/1983 Suda et al.
4,397,469 A 8/1983 Carter, III
4,421,312 A 12/1983 Delgado et al.
4,421,501 A 12/1983 Scheffer
D273,962 S 5/1984 Fromm
D274,069 S 5/1984 Fromm
4,457,512 A 7/1984 Stevenson
4,467,424 A 8/1984 Hedges et al.
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,531,187 A 7/1985 Uhland
4,534,562 A 8/1985 Cuff et al.
4,549,738 A 10/1985 Greitzer
4,566,782 A 1/1986 Britt et al.
4,575,367 A 3/1986 Karmel
4,586,712 A 5/1986 Lorber et al.
4,659,082 A 4/1987 Greenberg

(56) References Cited

U.S. PATENT DOCUMENTS 4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,412 A 9/1988 Wolfe
4,770,421 A 9/1988 Hoffman
4,807,884 A 2/1989 Breeding
4,822,050 A 4/1989 Normand et al.
4,832,342 A 5/1989 Plevyak et al.
4,858,000 A 8/1989 Lu
4,861,041 A 8/1989 Jones et al.
4,876,000 A 10/1989 Mikhail
4,900,009 A 2/1990 Kitahara et al.
4,904,830 A 2/1990 Rizzuto
4,921,109 A 5/1990 Hasuo et al.
4,926,327 A 5/1990 Sidley
4,948,134 A 8/1990 Suttle et al.
4,951,950 A 8/1990 Normand et al.
4,969,648 A 11/1990 Hollinger et al.
4,993,587 A 2/1991 Abe
4,995,615 A 2/1991 Cheng
5,000,453 A 3/1991 Stevens et al.
5,004,218 A 4/1991 Sardano et al.
5,039,102 A 8/1991 Miller
5,067,713 A 11/1991 Soules et al.
5,078,405 A 1/1992 Jones et al.
5,081,487 A 1/1992 Hoyer et al.
5,096,197 A 3/1992 Embury
5,102,293 A 4/1992 Schneider
5,118,114 A 6/1992 Tucci
5,121,192 A 6/1992 Kazui
5,121,921 A 6/1992 Friedman et al.
5,146,346 A 9/1992 Knoll
5,154,429 A 10/1992 Levasseur
5,179,517 A 1/1993 Sarbin et al.
5,197,094 A 3/1993 Tillery et al.
5,199,710 A 4/1993 Lamle
5,209,476 A 5/1993 Eiba
5,224,712 A 7/1993 Laughlin et al.
5,240,140 A 8/1993 Huen
5,248,142 A 9/1993 Breeding
5,257,179 A 10/1993 Demar
5,259,907 A 11/1993 Soules et al.
5,261,667 A 11/1993 Breeding
5,267,248 A 11/1993 Reyner
5,275,411 A 1/1994 Breeding
5,276,312 A 1/1994 McCarthy
5,283,422 A 2/1994 Storch et al.
5,288,081 A 2/1994 Breeding
5,299,089 A 3/1994 Lwee
5,303,921 A 4/1994 Breeding
5,344,146 A 9/1994 Lee
5,356,145 A 10/1994 Verschoor
5,362,053 A 11/1994 Miller
5,374,061 A 12/1994 Albrecht
5,377,973 A 1/1995 Jones et al.
5,382,024 A 1/1995 Blaha
5,382,025 A 1/1995 Sklansky et al.
5,390,910 A 2/1995 Mandel et al.
5,397,128 A 3/1995 Hesse et al.
5,397,133 A 3/1995 Penzias
5,416,308 A 5/1995 Hood et al.
5,431,399 A 7/1995 Kelley
5,431,407 A 7/1995 Hofberg et al.
5,437,462 A 8/1995 Breeding
5,445,377 A 8/1995 Steinbach
5,470,079 A 11/1995 Lestrange et al.
D365,853 S 1/1996 Zadro
5,489,101 A 2/1996 Moody
5,515,477 A 5/1996 Sutherland
5,524,888 A 6/1996 Heidel
5,531,448 A 7/1996 Moody
5,544,892 A 8/1996 Breeding
5,575,475 A 11/1996 Steinbach
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,632,483 A 5/1997 Garczynski et al.
5,636,843 A 6/1997 Roberts
5,651,548 A 7/1997 French et al.
5,655,961 A 8/1997 Acres et al.
5,655,966 A 8/1997 Werdin et al.
5,669,816 A 9/1997 Garczynski et al.
5,676,231 A 10/1997 Legras et al.
5,676,372 A 10/1997 Sines et al.
5,681,039 A 10/1997 Miller
5,683,085 A 11/1997 Johnson et al.
5,685,543 A 11/1997 Garner
5,690,324 A 11/1997 Otomo et al.
5,692,748 A 12/1997 Frisco et al.
5,695,189 A 12/1997 Breeding et al.
5,695,489 A 12/1997 Japuntich
5,701,565 A 12/1997 Morgan
5,707,286 A 1/1998 Carlson
5,707,287 A 1/1998 McCrea, Jr.
5,711,525 A 1/1998 Breeding
5,718,427 A 2/1998 Cranford et al.
5,719,288 A 2/1998 Sens et al.
5,720,484 A 2/1998 Hsu
5,722,893 A 3/1998 Hill et al.
5,735,525 A 4/1998 McCrea, Jr.
5,735,724 A 4/1998 Udagawa
5,735,742 A 4/1998 French
5,743,798 A 4/1998 Adams et al.
5,768,382 A 6/1998 Schneier et al.
5,770,533 A 6/1998 Franchi
5,770,553 A 6/1998 Kroner et al.
5,772,505 A 6/1998 Garczynski et al.
5,779,546 A 7/1998 Meissner et al.
5,781,647 A 7/1998 Fishbine et al.
5,785,321 A 7/1998 Van Putten et al.
5,788,574 A 8/1998 Ornstein et al.
5,791,988 A 8/1998 Nomi
5,802,560 A 9/1998 Joseph et al.
5,803,808 A 9/1998 Strisower
5,810,355 A 9/1998 Trilli
5,813,326 A 9/1998 Salomon
5,813,912 A 9/1998 Shultz
5,814,796 A 9/1998 Benson et al.
5,836,775 A 11/1998 Hiyama et al.
5,839,730 A 11/1998 Pike
5,845,906 A 12/1998 Wirth
5,851,011 A 12/1998 Lott
5,867,586 A 2/1999 Liang
5,879,233 A 3/1999 Stupero
5,883,804 A 3/1999 Christensen
5,890,717 A 4/1999 Rosewarne et al.
5,892,210 A 4/1999 Levasseur
5,909,876 A 6/1999 Brown
5,911,626 A 6/1999 McCrea, Jr.
5,919,090 A 7/1999 Mothwurf
D412,723 S 8/1999 Hachuel et al.
5,936,222 A 8/1999 Korsunsky et al.
5,941,769 A 8/1999 Order
5,944,310 A 8/1999 Johnson et al.
D414,527 S 9/1999 Tedham
5,957,776 A 9/1999 Hoehne
5,974,150 A 10/1999 Kaish et al.
5,989,122 A 11/1999 Roblejo
5,991,308 A 11/1999 Fuhrmann et al.
6,015,311 A 1/2000 Benjamin et al.
6,019,368 A 2/2000 Sines et al.
6,019,374 A 2/2000 Breeding
6,039,650 A 3/2000 Hill
6,050,569 A 4/2000 Taylor
6,053,695 A 4/2000 Longoria et al.
6,061,449 A 5/2000 Candelore et al.
6,068,258 A 5/2000 Breeding et al.
6,069,564 A 5/2000 Hatano et al.

(56) References Cited

U.S. PATENT DOCUMENTS 6,071,190 A 6/2000 Weiss et al.
6,093,103 A 7/2000 McCrea, Jr.
6,113,101 A 9/2000 Wirth
6,117,012 A 9/2000 McCrea, Jr.
6,123,010 A 9/2000 Blackstone
D432,588 S 10/2000 Tedham
6,126,166 A 10/2000 Lorson et al.
6,131,817 A 10/2000 Miller
6,139,014 A 10/2000 Breeding et al.
6,139,048 A 10/2000 Braunschaedel
6,149,154 A 11/2000 Grauzer et al.
6,154,131 A 11/2000 Jones et al.
6,165,069 A 12/2000 Sines et al.
6,165,072 A 12/2000 Davis et al.
6,183,362 B1 2/2001 Boushy
6,186,895 B1 2/2001 Oliver
6,196,416 B1 3/2001 Seagle
6,200,218 B1 3/2001 Lindsay
6,210,274 B1 4/2001 Carlson
6,213,310 B1 4/2001 Wennersten et al.
6,217,447 B1 4/2001 Lofink et al.
6,234,900 B1 5/2001 Cumbers
6,236,223 B1 5/2001 Brady et al.
6,250,632 B1 6/2001 Albrecht
6,254,002 B1 7/2001 Litman
6,254,096 B1 7/2001 Grauzer et al.
6,254,484 B1 7/2001 McCrea, Jr.
6,257,981 B1 7/2001 Acres et al.
6,267,248 B1 7/2001 Johnson et al.
6,267,648 B1 7/2001 Katayama et al.
6,267,671 B1 7/2001 Hogan
6,270,404 B2 8/2001 Sines et al.
6,272,223 B1 8/2001 Carlson
6,293,546 B1 9/2001 Hessing et al.
6,293,864 B1 9/2001 Romero
6,299,167 B1 10/2001 Sines et al.
6,299,534 B1 10/2001 Breeding et al.
6,299,536 B1 10/2001 Hill
6,308,886 B1 10/2001 Benson et al.
6,313,871 B1 11/2001 Schubert
6,325,373 B1 12/2001 Breeding et al.
6,334,614 B1 1/2002 Breeding
6,341,778 B1 1/2002 Lee
6,342,830 B1 1/2002 Want et al.
6,346,044 B1 2/2002 McCrea, Jr.
6,361,044 B1 3/2002 Block et al.
6,386,973 B1 5/2002 Yoseloff
6,402,142 B1 6/2002 Warren et al.
6,446,864 B1 9/2002 Kim et al.
6,454,266 B1 9/2002 Breeding et al.
6,460,848 B1 10/2002 Soltys et al.
6,464,584 B2 10/2002 Oliver
6,490,277 B1 12/2002 Tzotzkov
6,508,709 B1 1/2003 Karmarkar
6,514,140 B1 2/2003 Storch
6,517,435 B2 2/2003 Soltys et al.
6,517,436 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,543,770 B1 4/2003 Kaji et al.
6,561,897 B1 5/2003 Bourbour et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,582,302 B2 6/2003 Romero
6,585,586 B1 7/2003 Romero
6,585,588 B2 7/2003 Hartl
6,585,856 B2 7/2003 Zwick et al.
6,588,750 B1 7/2003 Grauzer et al.
6,588,751 B1 7/2003 Grauzer et al.
6,595,857 B2 7/2003 Soltys et al.
6,609,710 B1 8/2003 Order
6,612,928 B1 9/2003 Bradford et al.
6,616,535 B1 9/2003 Nishizaki et al.
6,619,662 B2 9/2003 Miller
6,622,185 B1 9/2003 Johnson et al.
6,626,757 B2 9/2003 Oliveras
6,629,019 B2 9/2003 Legge et al.
6,629,591 B1 10/2003 Griswold et al.
6,629,889 B2 10/2003 Mothwurf
6,629,894 B1 10/2003 Purton
6,637,622 B1 10/2003 Robinson
6,645,068 B1 11/2003 Kelly et al.
6,645,077 B2 11/2003 Rowe
6,651,985 B2 11/2003 Sines et al.
6,652,379 B2 11/2003 Soltys et al.
6,655,690 B1 12/2003 Oskwarek
6,658,135 B1 12/2003 Morito et al.
6,659,460 B2 12/2003 Blaha et al.
6,659,461 B2 12/2003 Yoseloff et al.
6,659,875 B2 12/2003 Purton
6,663,490 B2 12/2003 Soltys et al.
6,666,768 B1 12/2003 Akers
6,671,358 B1 12/2003 Seidman et al.
6,676,517 B2 1/2004 Beavers
6,680,843 B2 1/2004 Farrow et al.
6,685,564 B2 2/2004 Oliver
6,685,567 B2 2/2004 Cockerille et al.
6,685,568 B2 2/2004 Soltys et al.
6,688,597 B2 2/2004 Jones
6,688,979 B2 2/2004 Soltys et al.
6,690,673 B1 2/2004 Jarvis
6,698,756 B1 3/2004 Baker et al.
6,698,759 B2 3/2004 Webb et al.
6,702,289 B1 3/2004 Feola
6,702,290 B2 3/2004 Buono-Correa et al.
6,709,333 B1 3/2004 Bradford et al.
6,719,634 B2 4/2004 Mishina et al.
6,722,974 B2 4/2004 Sines et al.
6,726,205 B1 4/2004 Purton
6,732,067 B1 5/2004 Powderly
6,733,012 B2 5/2004 Bui et al.
6,733,388 B2 5/2004 Mothwurf
6,746,333 B1 6/2004 Onda et al.
6,747,560 B2 6/2004 Stevens, III
6,758,751 B2 7/2004 Soltys et al.
6,758,757 B2 7/2004 Luciano et al.
6,769,693 B2 8/2004 Huard et al.
6,774,782 B2 8/2004 Runyon et al.
6,789,801 B2 9/2004 Snow
6,802,510 B1 10/2004 Haber
6,804,763 B1 10/2004 Stockdale et al.
6,808,173 B2 10/2004 Snow
6,827,282 B2 12/2004 Silverbrook
6,834,251 B1 12/2004 Fletcher
6,840,517 B2 1/2005 Snow et al.
6,842,263 B1 1/2005 Saeki
6,843,725 B2 1/2005 Nelson
6,848,616 B2 2/2005 Tsirline et al.
6,848,844 B2 2/2005 McCue et al.
6,848,994 B1 2/2005 Knust et al.
6,857,961 B2 2/2005 Soltys et al.
6,874,784 B1 4/2005 Promutico et al.
6,874,786 B2 4/2005 Bruno et al.
6,877,657 B2 4/2005 Ranard et al.
6,877,748 B1 4/2005 Patroni et al.
6,889,979 B2 5/2005 Blaha et al.
6,893,347 B1 5/2005 Zilliacus et al.
6,899,628 B2 5/2005 Leen et al.
6,902,167 B2 6/2005 Webb
6,905,121 B1 6/2005 Timpano
6,923,446 B2 8/2005 Snow
6,938,900 B2 9/2005 Snow
6,941,180 B1 9/2005 Fischer et al.
6,950,948 B2 9/2005 Neff
6,955,599 B2 10/2005 Bourbour et al.
6,957,746 B2 10/2005 Martin et al.
6,959,925 B1 11/2005 Baker et al.
6,960,134 B2 11/2005 Hartl et al.

(56) References Cited

U.S. PATENT DOCUMENTS

| | | | |
|---|---|---|---|
| 6,964,612 | B2 | 11/2005 | Soltys et al. |
| 6,986,514 | B2 | 1/2006 | Snow |
| 6,988,516 | B2 | 1/2006 | Debaes et al. |
| 7,011,309 | B2 | 3/2006 | Soltys et al. |
| 7,020,307 | B2 | 3/2006 | Hinton et al. |
| 7,028,598 | B2 | 4/2006 | Teshima |
| 7,029,009 | B2 | 4/2006 | Grauzer et al. |
| 7,036,818 | B2 | 5/2006 | Grauzer et al. |
| 7,046,458 | B2 | 5/2006 | Nakayama |
| 7,046,764 | B1 | 5/2006 | Kump |
| 7,048,629 | B2 | 5/2006 | Sines et al. |
| 7,066,464 | B2 | 6/2006 | Blad et al. |
| 7,068,822 | B2 | 6/2006 | Scott |
| 7,079,010 | B2 | 7/2006 | Champlin |
| 7,084,769 | B2 | 8/2006 | Bauer et al. |
| 7,089,420 | B1 | 8/2006 | Durst et al. |
| D527,900 | S | 9/2006 | Dewa et al. |
| 7,106,201 | B2 | 9/2006 | Tuttle |
| 7,113,094 | B2 | 9/2006 | Garber et al. |
| 7,114,718 | B2 | 10/2006 | Grauzer et al. |
| 7,128,652 | B1 | 10/2006 | Lavoie et al. |
| 7,139,108 | B2 | 11/2006 | Andersen et al. |
| 7,140,614 | B2 | 11/2006 | Snow |
| 7,162,035 | B1 | 1/2007 | Durst et al. |
| 7,165,769 | B2 | 1/2007 | Crenshaw et al. |
| 7,165,770 | B2 | 1/2007 | Snow |
| 7,175,522 | B2 | 2/2007 | Hartl |
| 7,186,181 | B2 | 3/2007 | Rowe |
| 7,201,656 | B2 | 4/2007 | Darder |
| 7,202,888 | B2 | 4/2007 | Tecu et al. |
| 7,203,841 | B2 | 4/2007 | Jackson et al. |
| 7,222,852 | B2 | 5/2007 | Soltys et al. |
| 7,222,855 | B2 | 5/2007 | Sorge |
| 7,231,812 | B1 | 6/2007 | Lagare |
| 7,234,698 | B2 | 6/2007 | Grauzer et al. |
| 7,237,969 | B2 | 7/2007 | Bartman |
| 7,243,148 | B2 | 7/2007 | Keir et al. |
| 7,243,698 | B2 | 7/2007 | Siegel |
| 7,246,799 | B2 | 7/2007 | Snow |
| 7,255,642 | B2 | 8/2007 | Sines et al. |
| 7,257,630 | B2 | 8/2007 | Cole et al. |
| 7,261,294 | B2 | 8/2007 | Grauzer et al. |
| 7,264,241 | B2 | 9/2007 | Schubert et al. |
| 7,264,243 | B2 | 9/2007 | Yoseloff et al. |
| 7,277,570 | B2 | 10/2007 | Armstrong |
| 7,278,923 | B2 | 10/2007 | Grauzer et al. |
| 7,294,056 | B2 | 11/2007 | Lowell et al. |
| 7,297,062 | B2 | 11/2007 | Gatto et al. |
| 7,300,056 | B2 | 11/2007 | Gioia et al. |
| 7,303,473 | B2 | 12/2007 | Rowe |
| 7,303,475 | B2 | 12/2007 | Britt et al. |
| 7,309,065 | B2 | 12/2007 | Yoseloff et al. |
| 7,316,609 | B2 | 1/2008 | Dunn et al. |
| 7,331,579 | B2 | 2/2008 | Snow |
| 7,334,794 | B2 | 2/2008 | Snow |
| 7,338,044 | B2 | 3/2008 | Grauzer et al. |
| 7,338,362 | B1 | 3/2008 | Gallagher |
| 7,341,510 | B2 | 3/2008 | Bourbour et al. |
| D566,784 | S | 4/2008 | Palmer |
| 7,357,321 | B2 | 4/2008 | Yoshida et al. |
| 7,360,094 | B2 | 4/2008 | Neff |
| 7,367,561 | B2 | 5/2008 | Blaha et al. |
| 7,367,563 | B2 | 5/2008 | Yoseloff et al. |
| 7,367,565 | B2 | 5/2008 | Chiu |
| 7,367,884 | B2 | 5/2008 | Breeding et al. |
| 7,384,044 | B2 | 6/2008 | Grauzer et al. |
| 7,387,300 | B2 | 6/2008 | Snow |
| 7,389,990 | B2 | 6/2008 | Mourad |
| 7,399,226 | B2 | 7/2008 | Mishra |
| 7,407,438 | B2 | 8/2008 | Schubert et al. |
| 7,434,805 | B2 | 10/2008 | Grauzer et al. |
| 7,436,957 | B1 | 10/2008 | Fischer et al. |
| 7,448,626 | B2 | 11/2008 | Fleckenstein |
| 7,458,582 | B2 | 12/2008 | Snow et al. |
| 7,461,843 | B1 | 12/2008 | Baker et al. |
| 7,464,932 | B2 | 12/2008 | Darling |
| 7,464,934 | B2 | 12/2008 | Schwartz |
| 7,472,906 | B2 | 1/2009 | Shai |
| 7,478,813 | B1 | 1/2009 | Hofferber et al. |
| 7,500,672 | B2 | 3/2009 | Ho |
| 7,506,874 | B2 | 3/2009 | Hall |
| 7,510,186 | B2 | 3/2009 | Fleckenstein |
| 7,510,190 | B2 | 3/2009 | Snow et al. |
| 7,510,194 | B2 | 3/2009 | Soltys et al. |
| 7,510,478 | B2 | 3/2009 | Benbrahim et al. |
| 7,513,437 | B2 | 4/2009 | Douglas |
| 7,515,718 | B2 | 4/2009 | Nguyen et al. |
| 7,523,935 | B2 | 4/2009 | Grauzer et al. |
| 7,523,936 | B2 | 4/2009 | Grauzer et al. |
| 7,523,937 | B2 | 4/2009 | Fleckenstein |
| 7,525,510 | B2 | 4/2009 | Beland et al. |
| 7,540,498 | B2 | 6/2009 | Crenshaw et al. |
| 7,549,643 | B2 | 6/2009 | Quach |
| 7,554,753 | B2 | 6/2009 | Wakamiya |
| 7,556,197 | B2 | 7/2009 | Yoshida et al. |
| 7,575,237 | B2 | 8/2009 | Snow |
| 7,578,506 | B2 | 8/2009 | Lambert |
| 7,584,963 | B2 | 9/2009 | Krenn et al. |
| 7,584,966 | B2 | 9/2009 | Snow |
| 7,591,728 | B2 | 9/2009 | Gioia et al. |
| 7,597,623 | B2 | 10/2009 | Grauzer et al. |
| 7,644,923 | B1 | 1/2010 | Dickinson et al. |
| 7,661,676 | B2 | 2/2010 | Smith et al. |
| 7,666,090 | B2 | 2/2010 | Hettinger |
| 7,669,853 | B2 | 3/2010 | Jones |
| 7,686,681 | B2 | 3/2010 | Soltys et al. |
| 7,744,452 | B2 | 6/2010 | Cimring et al. |
| 7,753,374 | B2 | 7/2010 | Ho |
| 7,758,425 | B2 | 7/2010 | Poh et al. |
| 7,762,554 | B2 | 7/2010 | Ho |
| 7,766,332 | B2 | 8/2010 | Grauzer et al. |
| 7,766,333 | B1 | 8/2010 | Stardust et al. |
| 7,769,853 | B2 | 8/2010 | Nezamzadeh |
| 7,773,749 | B1 | 8/2010 | Durst et al. |
| 7,780,529 | B2 | 8/2010 | Rowe et al. |
| 7,784,790 | B2 | 8/2010 | Grauzer et al. |
| 7,804,982 | B2 | 9/2010 | Howard et al. |
| 7,824,255 | B2 | 11/2010 | Lutnick et al. |
| 7,846,020 | B2 | 12/2010 | Walker et al. |
| 7,874,559 | B1 | 1/2011 | Tseng |
| 7,890,365 | B2 | 2/2011 | Hettinger |
| 7,900,923 | B2 | 3/2011 | Toyama et al. |
| 7,908,169 | B2 | 3/2011 | Hettinger |
| 7,931,533 | B2 | 4/2011 | Lemay et al. |
| 7,946,586 | B2 | 5/2011 | Krenn et al. |
| 7,959,153 | B2 | 6/2011 | Franks, Jr. |
| 7,976,023 | B1 | 7/2011 | Hessing et al. |
| 7,988,554 | B2 | 8/2011 | Lemay et al. |
| 7,995,196 | B1 | 8/2011 | Fraser |
| 8,002,638 | B2 | 8/2011 | Grauzer et al. |
| 8,011,661 | B2 | 9/2011 | Stasson |
| 8,016,663 | B2 | 9/2011 | Soltys et al. |
| 8,021,231 | B2 | 9/2011 | Walker et al. |
| 8,025,294 | B2 | 9/2011 | Grauzer et al. |
| 8,038,521 | B2 | 10/2011 | Grauzer et al. |
| RE42,944 | E | 11/2011 | Blaha et al. |
| 8,057,302 | B2 | 11/2011 | Wells et al. |
| 8,062,134 | B2 | 11/2011 | Kelly et al. |
| 8,070,574 | B2 | 12/2011 | Grauzer et al. |
| 8,092,307 | B2 | 1/2012 | Kelly |
| 8,109,514 | B2 | 2/2012 | Toyama |
| 8,150,158 | B2 | 4/2012 | Downs, III |
| 8,171,567 | B1 | 5/2012 | Fraser et al. |
| 8,210,536 | B2 | 7/2012 | Blaha et al. |
| 8,251,293 | B2 | 8/2012 | Nagata et al. |
| 8,251,802 | B2 | 8/2012 | Snow |
| 8,270,603 | B1 | 9/2012 | Durst et al. |
| 8,287,347 | B2 | 10/2012 | Snow et al. |
| 8,287,386 | B2 | 10/2012 | Miller et al. |
| 8,319,666 | B2 | 11/2012 | Weinmann et al. |
| 8,342,525 | B2 | 1/2013 | Scheper et al. |
| 8,342,526 | B1 | 1/2013 | Sampson et al. |
| 8,342,529 | B2 | 1/2013 | Snow |
| 8,353,513 | B2 | 1/2013 | Swanson |

(56) References Cited

U.S. PATENT DOCUMENTS 8,419,521 B2 4/2013 Grauzer et al.
8,429,229 B2 4/2013 Sepich et al.
8,444,489 B2 5/2013 Lian et al.
8,475,252 B2 7/2013 Savage et al.
8,498,444 B2 7/2013 Sharma
8,505,916 B2 8/2013 Grauzer et al.
8,512,146 B2 8/2013 Gururajan et al.
8,548,327 B2 10/2013 Hirth et al.
8,550,464 B2 10/2013 Soltys et al.
8,556,263 B2 10/2013 Grauzer et al.
8,590,895 B2 11/2013 Kwon
RE44,616 E 12/2013 Blaha et al.
8,602,416 B2 12/2013 Toyama
8,616,552 B2 12/2013 Czyzewski et al.
8,662,500 B2 3/2014 Swanson
8,695,978 B1 4/2014 Ho
8,702,100 B2 4/2014 Snow et al.
8,702,101 B2 4/2014 Scheper et al.
8,720,891 B2 5/2014 Hessing et al.
8,758,111 B2 6/2014 Lutnick
8,777,727 B2 7/2014 Jones
8,820,745 B2 9/2014 Grauzer et al.
8,844,931 B2 9/2014 Blaha et al.
8,919,775 B2 12/2014 Wadds et al.
8,969,802 B1 3/2015 Blazevic
9,101,821 B2 8/2015 Snow
9,220,972 B2 12/2015 Grauzer et al.
9,251,661 B2 2/2016 Tammesoo
9,254,435 B2 2/2016 Miller et al.
9,266,012 B2 2/2016 Grauzer et al.
9,280,866 B2 3/2016 Nayak et al.
9,316,597 B2 4/2016 Blazevic
9,378,766 B2 6/2016 Kelly et al.
9,387,390 B2 7/2016 Downs et al.
9,474,957 B2 10/2016 Haushalter et al.
9,504,905 B2 11/2016 Kelly et al.
9,511,274 B2 12/2016 Kelly et al.
9,539,495 B2 1/2017 Scheper et al.
9,566,501 B2 2/2017 Stasson et al.
9,573,047 B1 2/2017 Riordan et al.
9,679,603 B2 6/2017 Kelly et al.
9,713,761 B2 7/2017 Sampson et al.
9,764,221 B2 9/2017 Swanson
9,849,368 B2 12/2017 Stasson et al.
9,901,810 B2 2/2018 Rynda et al.
9,908,034 B2 3/2018 Downs et al.
10,092,820 B2 10/2018 Riordan et al.
10,124,241 B2 11/2018 Stasson et al.
10,238,954 B2 3/2019 Stasson et al.
10,339,765 B2 7/2019 Nagaragatta et al.
10,486,055 B2 11/2019 Kelly et al.
10,668,361 B2 6/2020 Stasson et al.
10,857,448 B2 12/2020 Kelly et al.
10,933,300 B2 3/2021 Helsen et al.
11,173,383 B2 11/2021 Krenn et al.
2001/0035604 A1 11/2001 Jones
2001/0036231 A1 11/2001 Easwar et al.
2001/0036866 A1 11/2001 Stockdale et al.
2001/0054576 A1 12/2001 Stardust et al.
2002/0017481 A1 2/2002 Johnson et al.
2002/0045478 A1 4/2002 Soltys et al.
2002/0045481 A1 4/2002 Soltys et al.
2002/0063389 A1 5/2002 Breeding et al.
2002/0070499 A1 6/2002 Breeding et al.
2002/0094869 A1 7/2002 Harkham
2002/0107067 A1 8/2002 McGlone et al.
2002/0107072 A1 8/2002 Giobbi
2002/0113368 A1 8/2002 Hessing et al.
2002/0135692 A1 9/2002 Fujinawa
2002/0142820 A1 10/2002 Bartlett
2002/0155869 A1 10/2002 Soltys et al.
2002/0163122 A1 11/2002 Vancura
2002/0163125 A1 11/2002 Grauzer et al.
2002/0187821 A1 12/2002 Soltys et al.
2002/0187830 A1 12/2002 Stockdale et al.
2003/0003997 A1 1/2003 Vuong et al.
2003/0007143 A1 1/2003 McArthur et al.
2003/0042673 A1 3/2003 Grauzer et al.
2003/0048476 A1 3/2003 Yamakawa
2003/0052449 A1 3/2003 Grauzer et al.
2003/0052450 A1 3/2003 Grauzer et al.
2003/0064798 A1 4/2003 Grauzer et al.
2003/0067112 A1 4/2003 Grauzer et al.
2003/0075865 A1 4/2003 Grauzer et al.
2003/0087694 A1 5/2003 Storch
2003/0090059 A1 5/2003 Grauzer et al.
2003/0094756 A1 5/2003 Grauzer et al.
2003/0151194 A1 8/2003 Hessing et al.
2003/0195025 A1 10/2003 Hill
2004/0015423 A1 1/2004 Walker et al.
2004/0067789 A1 4/2004 Grauzer et al.
2004/0100026 A1 5/2004 Haggard
2004/0108255 A1 6/2004 Johnson
2004/0108654 A1 6/2004 Grauzer et al.
2004/0116179 A1 6/2004 Nicely et al.
2004/0180722 A1 9/2004 Giobbi
2004/0224777 A1 11/2004 Smith et al.
2004/0245720 A1 12/2004 Grauzer et al.
2004/0259618 A1 12/2004 Soltys et al.
2005/0012671 A1 1/2005 Bisig
2005/0012818 A1 1/2005 Kiely et al.
2005/0026680 A1 2/2005 Gururajan
2005/0035548 A1 2/2005 Yoseloff et al.
2005/0037843 A1 2/2005 Wells et al.
2005/0040594 A1 2/2005 Krenn et al.
2005/0051955 A1 3/2005 Schubert et al.
2005/0051956 A1 3/2005 Grauzer et al.
2005/0062228 A1 3/2005 Grauzer et al.
2005/0062229 A1 3/2005 Grauzer et al.
2005/0082750 A1 4/2005 Grauzer et al.
2005/0093231 A1 5/2005 Grauzer et al.
2005/0104289 A1 5/2005 Grauzer et al.
2005/0104290 A1 5/2005 Grauzer et al.
2005/0110210 A1 5/2005 Soltys et al.
2005/0113166 A1 5/2005 Grauzer et al.
2005/0113171 A1 5/2005 Hodgson
2005/0119048 A1 6/2005 Soltys et al.
2005/0121852 A1 6/2005 Soltys et al.
2005/0137005 A1 6/2005 Soltys et al.
2005/0140090 A1 6/2005 Breeding et al.
2005/0148391 A1 7/2005 Tain
2005/0164759 A1 7/2005 Smith et al.
2005/0164761 A1 7/2005 Tain
2005/0192092 A1 9/2005 Breckner et al.
2005/0206077 A1 9/2005 Grauzer et al.
2005/0242500 A1 11/2005 Downs, III
2005/0272501 A1 12/2005 Tran et al.
2005/0277463 A1 12/2005 Knust et al.
2005/0288083 A1 12/2005 Downs, III
2005/0288086 A1 12/2005 Schubert et al.
2006/0027970 A1 2/2006 Kyrychenko
2006/0033269 A1 2/2006 Grauzer et al.
2006/0033270 A1 2/2006 Grauzer et al.
2006/0046853 A1 3/2006 Black
2006/0055114 A1 3/2006 White et al.
2006/0063577 A1 3/2006 Downs et al.
2006/0066048 A1 3/2006 Krenn et al.
2006/0084502 A1 4/2006 Downs et al.
2006/0151946 A1 7/2006 Ngai
2006/0183540 A1 8/2006 Grauzer et al.
2006/0189381 A1 8/2006 Daniel et al.
2006/0199649 A1 9/2006 Soltys et al.
2006/0205508 A1 9/2006 Green
2006/0220312 A1 10/2006 Baker et al.
2006/0220313 A1 10/2006 Baker et al.
2006/0252521 A1 11/2006 Gururajan et al.
2006/0252554 A1 11/2006 Gururajan et al.
2006/0279040 A1 12/2006 Downs et al.
2007/0001395 A1 1/2007 Gioia et al.
2007/0006708 A1 1/2007 Laakso
2007/0015583 A1 1/2007 Tran
2007/0018389 A1 1/2007 Downs, III
2007/0045959 A1 3/2007 Soltys
2007/0049368 A1 3/2007 Kuhn et al.

(56) References Cited

U.S. PATENT DOCUMENTS

| | | | |
|---|---|---|---|
| 2007/0057454 | A1 | 3/2007 | Fleckenstein |
| 2007/0057469 | A1 | 3/2007 | Grauzer et al. |
| 2007/0066387 | A1 | 3/2007 | Matsuno et al. |
| 2007/0069462 | A1 | 3/2007 | Downs et al. |
| 2007/0072677 | A1 | 3/2007 | Lavoie et al. |
| 2007/0111773 | A1 | 5/2007 | Gururajan et al. |
| 2007/0148283 | A1 | 6/2007 | Harvey et al. |
| 2007/0184905 | A1 | 8/2007 | Gatto et al. |
| 2007/0197294 | A1 | 8/2007 | Gong |
| 2007/0197298 | A1 | 8/2007 | Rowe |
| 2007/0202941 | A1 | 8/2007 | Miltenberger et al. |
| 2007/0222147 | A1 | 9/2007 | Blaha et al. |
| 2007/0225055 | A1 | 9/2007 | Weisman |
| 2007/0233567 | A1 | 10/2007 | Daly |
| 2007/0238506 | A1 | 10/2007 | Ruckle |
| 2007/0241498 | A1 | 10/2007 | Soltys |
| 2007/0259709 | A1 | 11/2007 | Kelly et al. |
| 2007/0267812 | A1 | 11/2007 | Grauzer et al. |
| 2007/0272600 | A1 | 11/2007 | Johnson |
| 2007/0287534 | A1 | 12/2007 | Fleckenstein |
| 2007/0290438 | A1 | 12/2007 | Grauzer et al. |
| 2007/0298865 | A1 | 12/2007 | Soltys |
| 2008/0004107 | A1 | 1/2008 | Nguyen et al. |
| 2008/0022415 | A1 | 1/2008 | Kuo et al. |
| 2008/0032763 | A1 | 2/2008 | Giobbi |
| 2008/0039192 | A1 | 2/2008 | Laut |
| 2008/0039208 | A1 | 2/2008 | Abrink et al. |
| 2008/0096656 | A1 | 4/2008 | Lemay et al. |
| 2008/0111300 | A1 | 5/2008 | Czyzewski et al. |
| 2008/0113783 | A1 | 5/2008 | Czyzewski et al. |
| 2008/0136108 | A1 | 6/2008 | Polay |
| 2008/0143048 | A1 | 6/2008 | Shigeta |
| 2008/0176627 | A1 | 7/2008 | Lardie |
| 2008/0217218 | A1 | 9/2008 | Johnson |
| 2008/0234046 | A1 | 9/2008 | Kinsley |
| 2008/0234047 | A1 | 9/2008 | Nguyen |
| 2008/0248875 | A1 | 10/2008 | Beatty |
| 2008/0284096 | A1 | 11/2008 | Toyama et al. |
| 2008/0315517 | A1 | 12/2008 | Toyama |
| 2009/0026700 | A2 | 1/2009 | Shigeta |
| 2009/0048026 | A1 | 2/2009 | French |
| 2009/0054161 | A1 | 2/2009 | Schubert et al. |
| 2009/0072477 | A1 | 3/2009 | Tseng |
| 2009/0091078 | A1 | 4/2009 | Grauzer et al. |
| 2009/0100409 | A1 | 4/2009 | Toneguzzo |
| 2009/0104963 | A1 | 4/2009 | Burman et al. |
| 2009/0121429 | A1 | 5/2009 | Walsh |
| 2009/0134575 | A1 | 5/2009 | Dickinson et al. |
| 2009/0140492 | A1 | 6/2009 | Yoseloff et al. |
| 2009/0166970 | A1 | 7/2009 | Rosh |
| 2009/0176547 | A1 | 7/2009 | Katz |
| 2009/0179378 | A1 | 7/2009 | Amaitis et al. |
| 2009/0186676 | A1 | 7/2009 | Amaitis et al. |
| 2009/0191933 | A1 | 7/2009 | French |
| 2009/0194988 | A1 | 8/2009 | Wright et al. |
| 2009/0197662 | A1 | 8/2009 | Wright et al. |
| 2009/0224476 | A1 | 9/2009 | Grauzer et al. |
| 2009/0227318 | A1 | 9/2009 | Wright et al. |
| 2009/0227360 | A1 | 9/2009 | Gioia et al. |
| 2009/0243213 | A1 | 10/2009 | Pececnik et al. |
| 2009/0250873 | A1 | 10/2009 | Jones |
| 2009/0253478 | A1 | 10/2009 | Walker et al. |
| 2009/0253503 | A1 | 10/2009 | Krise et al. |
| 2009/0267297 | A1 | 10/2009 | Blaha et al. |
| 2009/0283969 | A1 | 11/2009 | Tseng |
| 2009/0298577 | A1 | 12/2009 | Gagner et al. |
| 2009/0302535 | A1 | 12/2009 | Ho |
| 2009/0302536 | A1 | 12/2009 | Ho |
| 2009/0302537 | A1 | 12/2009 | Ho |
| 2009/0312093 | A1 | 12/2009 | Walker et al. |
| 2009/0314188 | A1 | 12/2009 | Toyama et al. |
| 2010/0013152 | A1 | 1/2010 | Grauzer et al. |
| 2010/0048304 | A1 | 2/2010 | Boesen |
| 2010/0069155 | A1 | 3/2010 | Schwartz et al. |
| 2010/0178987 | A1 | 7/2010 | Pacey |
| 2010/0197410 | A1 | 8/2010 | Leen et al. |
| 2010/0234110 | A1 | 9/2010 | Clarkson |
| 2010/0240440 | A1 | 9/2010 | Szrek et al. |
| 2010/0244376 | A1 | 9/2010 | Johnson |
| 2010/0252992 | A1 | 10/2010 | Sines |
| 2010/0255899 | A1 | 10/2010 | Paulsen |
| 2010/0276880 | A1 | 11/2010 | Grauzer et al. |
| 2010/0311493 | A1 | 12/2010 | Miller et al. |
| 2010/0311494 | A1 | 12/2010 | Miller et al. |
| 2010/0314830 | A1 | 12/2010 | Grauzer et al. |
| 2010/0320685 | A1 | 12/2010 | Grauzer et al. |
| 2011/0006480 | A1 | 1/2011 | Grauzer et al. |
| 2011/0012303 | A1 | 1/2011 | Kourgiantakis et al. |
| 2011/0024981 | A1 | 2/2011 | Tseng |
| 2011/0052049 | A1 | 3/2011 | Rajaraman et al. |
| 2011/0062662 | A1 | 3/2011 | Ohta et al. |
| 2011/0078096 | A1 | 3/2011 | Bounds |
| 2011/0079959 | A1 | 4/2011 | Hartley |
| 2011/0105208 | A1 | 5/2011 | Bickley |
| 2011/0109042 | A1 | 5/2011 | Rynda et al. |
| 2011/0130185 | A1 | 6/2011 | Walker |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0183748 | A1 | 7/2011 | Wilson et al. |
| 2011/0230148 | A1 | 9/2011 | Demuynck et al. |
| 2011/0230268 | A1 | 9/2011 | Williams |
| 2011/0269529 | A1 | 11/2011 | Baerlocher |
| 2011/0272881 | A1 | 11/2011 | Sines |
| 2011/0285081 | A1 | 11/2011 | Stasson |
| 2011/0285082 | A1 | 11/2011 | Krenn et al. |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0062745 | A1 | 3/2012 | Han et al. |
| 2012/0074646 | A1 | 3/2012 | Grauzer et al. |
| 2012/0091656 | A1 | 4/2012 | Blaha et al. |
| 2012/0095982 | A1 | 4/2012 | Lennington et al. |
| 2012/0161393 | A1 | 6/2012 | Krenn et al. |
| 2012/0175841 | A1 | 7/2012 | Grauzer et al. |
| 2012/0181747 | A1 | 7/2012 | Grauzer et al. |
| 2012/0187625 | A1 | 7/2012 | Downs et al. |
| 2012/0242782 | A1 | 9/2012 | Huang |
| 2012/0286471 | A1 | 11/2012 | Grauzer et al. |
| 2012/0306152 | A1 | 12/2012 | Krishnamurty et al. |
| 2013/0020761 | A1 | 1/2013 | Sines et al. |
| 2013/0023318 | A1 | 1/2013 | Abrahamson |
| 2013/0026709 | A1 | 1/2013 | Sampson et al. |
| 2013/0085638 | A1 | 4/2013 | Weinmann et al. |
| 2013/0109455 | A1 | 5/2013 | Grauzer et al. |
| 2013/0132306 | A1 | 5/2013 | Kami et al. |
| 2013/0147116 | A1 | 6/2013 | Stasson |
| 2013/0161905 | A1 | 6/2013 | Grauzer et al. |
| 2013/0228972 | A1 | 9/2013 | Grauzer et al. |
| 2013/0241147 | A1 | 9/2013 | McGrath |
| 2013/0300059 | A1 | 11/2013 | Sampson et al. |
| 2013/0337922 | A1 | 12/2013 | Kuhn et al. |
| 2014/0027979 | A1 | 1/2014 | Stasson et al. |
| 2014/0094239 | A1 | 4/2014 | Grauzer et al. |
| 2014/0103606 | A1 | 4/2014 | Grauzer et al. |
| 2014/0138907 | A1 | 5/2014 | Rynda et al. |
| 2014/0145399 | A1 | 5/2014 | Krenn et al. |
| 2014/0171170 | A1 | 6/2014 | Krishnamurty et al. |
| 2014/0175724 | A1 | 6/2014 | Huhtala et al. |
| 2014/0183818 | A1 | 7/2014 | Czyzewski et al. |
| 2014/0309006 | A1 | 10/2014 | Shigeta |
| 2014/0346732 | A1 | 11/2014 | Blaha et al. |
| 2015/0014926 | A1 | 1/2015 | Scheper et al. |
| 2015/0021242 | A1 | 1/2015 | Johnson |
| 2015/0196833 | A1 | 7/2015 | Scheper et al. |
| 2015/0196834 | A1 | 7/2015 | Scheper et al. |
| 2015/0238848 | A1 | 8/2015 | Kuhn et al. |
| 2015/0251079 | A1 | 9/2015 | Wright |

(56) References Cited

U.S. PATENT DOCUMENTS

| | | | |
|---|---|---|---|
| 2015/0290528 | A1 | 10/2015 | Sampson et al. |
| 2015/0290529 | A1 | 10/2015 | Bourbour et al. |
| 2016/0014351 | A1 | 1/2016 | Blazevic |
| 2016/0220893 | A1 | 8/2016 | Czyzewski et al. |
| 2017/0157499 | A1 | 6/2017 | Krenn et al. |
| 2018/0043241 | A1 | 2/2018 | Blaha et al. |
| 2018/0089956 | A1 | 3/2018 | Nagaragatta et al. |
| 2018/0200610 | A1 | 7/2018 | Riordan et al. |
| 2018/0207514 | A1 | 7/2018 | Blaha et al. |

FOREIGN PATENT DOCUMENTS

| | | | |
|---|---|---|---|
| AU | 06978/05 | B2 | 10/1998 |
| AU | 0757636 | B2 | 2/2003 |
| CA | 2266555 | A1 | 4/1998 |
| CA | 2284017 | C | 5/2006 |
| CA | 2612138 | A1 | 12/2006 |
| CA | 2823738 | A1 | 2/2015 |
| CA | 2669167 | C | 5/2016 |
| CN | 2051521 | U | 1/1990 |
| CN | 1341245 | A | 3/2002 |
| CN | 1383099 | A | 12/2002 |
| CN | 1824356 | A | 8/2006 |
| CN | 2848303 | Y | 12/2006 |
| CN | 2855481 | Y | 1/2007 |
| CN | 1933881 | A | 3/2007 |
| CN | 2877425 | Y | 3/2007 |
| CN | 101025603 | A | 8/2007 |
| CN | 101044520 | A | 9/2007 |
| CN | 200954370 | Y | 10/2007 |
| CN | 200987893 | Y | 12/2007 |
| CN | 101099896 | A | 1/2008 |
| CN | 101127131 | A | 2/2008 |
| CN | 101134141 | A | 3/2008 |
| CN | 201085907 | Y | 7/2008 |
| CN | 201132058 | Y | 10/2008 |
| CN | 201139926 | Y | 10/2008 |
| CN | 101437586 | A | 5/2009 |
| CN | 100571826 | C | 12/2009 |
| CN | 101711177 | A | 5/2010 |
| CN | 1771077 | B | 6/2010 |
| CN | 201832397 | U | 5/2011 |
| CN | 102125756 | A | 7/2011 |
| CN | 102170944 | A | 8/2011 |
| CN | 101783011 | B | 12/2011 |
| CN | 102847311 | A | 1/2013 |
| CN | 202724641 | U | 2/2013 |
| CN | 202983149 | U | 6/2013 |
| CN | 103025393 | B | 5/2015 |
| CZ | 0024952 | U1 | 2/2013 |
| DE | 0291230 | C | 4/1916 |
| DE | 2757341 | A1 | 6/1978 |
| DE | 2816377 | A1 | 10/1979 |
| DE | 3807127 | A1 | 9/1989 |
| EP | 0777514 | B1 | 2/2000 |
| EP | 1194888 | A1 | 4/2002 |
| EP | 1502631 | A1 | 2/2005 |
| EP | 1713026 | A1 | 10/2006 |
| EP | 2228106 | A1 | 9/2010 |
| EP | 1575261 | B1 | 8/2012 |
| FR | 2375918 | A1 | 7/1978 |
| GB | 0289552 | A | 4/1928 |
| GB | 0337147 | A | 10/1930 |
| GB | 0414014 | A | 7/1934 |
| GB | 0672616 | A | 5/1952 |
| GB | 2382567 | A | 6/2003 |
| JP | 10-063933 | A | 3/1998 |
| JP | 11-045321 | A | 2/1999 |
| JP | 2000-251031 | A | 9/2000 |
| JP | 2001-327647 | A | 11/2001 |
| JP | 2002-165916 | A | 6/2002 |
| JP | 2003-154320 | A | 5/2003 |
| JP | 2003-250950 | A | 9/2003 |
| JP | 2005-198668 | A | 7/2005 |
| JP | 2006-092140 | A | 4/2006 |
| JP | 2008-246061 | A | 10/2008 |
| JP | 4586474 | B2 | 11/2010 |
| KR | 2018-0090299 | A | 8/2018 |
| TW | M335308 | U | 7/2008 |
| TW | M357307 | U | 5/2009 |
| TW | M359356 | U | 6/2009 |
| TW | I345476 | B | 7/2011 |
| TW | I468209 | B | 1/2015 |
| TW | I481436 | B | 4/2015 |
| WO | 87/00445 | A1 | 1/1987 |
| WO | 87/00764 | A1 | 2/1987 |
| WO | 92/21413 | A1 | 12/1992 |
| WO | 95/28210 | A1 | 10/1995 |
| WO | 96/07153 | A1 | 3/1996 |
| WO | 97/10577 | A1 | 3/1997 |
| WO | 98/14249 | A1 | 4/1998 |
| WO | 98/40136 | A1 | 9/1998 |
| WO | 99/43404 | A1 | 9/1999 |
| WO | 99/52610 | A1 | 10/1999 |
| WO | 99/52611 | A1 | 10/1999 |
| WO | 00/51076 | A1 | 8/2000 |
| WO | 01/56670 | A1 | 8/2001 |
| WO | 02/05914 | A1 | 1/2002 |
| WO | 01/78854 | A3 | 2/2002 |
| WO | 2003/004116 | A1 | 1/2003 |
| WO | 03/26763 | A1 | 4/2003 |
| WO | 2004/067889 | A1 | 8/2004 |
| WO | 2004/112923 | A1 | 12/2004 |
| WO | 2006/031472 | A2 | 3/2006 |
| WO | 06/39308 | A2 | 4/2006 |
| WO | 2007/117268 | A1 | 10/2007 |
| WO | 2008/005285 | A2 | 1/2008 |
| WO | 2008/005286 | A2 | 1/2008 |
| WO | 2008/006023 | A2 | 1/2008 |
| WO | 2008/091809 | A2 | 7/2008 |
| WO | 2009/067758 | A1 | 6/2009 |
| WO | 2009/137541 | A2 | 11/2009 |
| WO | 2010/001032 | A1 | 1/2010 |
| WO | 2010/052573 | A2 | 5/2010 |
| WO | 2010/055328 | A1 | 5/2010 |
| WO | 2010/117446 | A1 | 10/2010 |
| WO | 2012/053074 | A1 | 4/2012 |
| WO | 2013/019677 | A1 | 2/2013 |
| WO | 2016/049619 | A1 | 3/2016 |
| WO | 2016/058085 | A9 | 5/2016 |

OTHER PUBLICATIONS

DVD Labeled "Luciano Deel. Ex. K". This DVD includes the video taped live Declaration of Mr. Luciano taken during preparation of litigation (Oct. 23, 2003).

DVD Labeled "Morrill Decl. Ex. A". This DVD includes the video taped live Declaration of Mr. Robert Morrill, a lead trial counsel for the defense, taken during preparation for litigation. He is describing the operation of the Rohiejo Prototype device, (Jan. 15, 2004). DVD sent to Examiner by US Postal Service with this PTO/SB/08.

DVD labeled Luciano Decl. Ex. K is (see Binder 2-1, p. 215/237, Luciano Decl., para.14): A video demonstration (11 minutes) of a Luciano Packaging prototype shuffler. DVD sent to Examiner by US Postal Service with this PTO/SB/08 form.

DVD labeled Morrill Deck Ex. A is (see Binder 4-1, p. 149/206, Morrill Deck, para. 2.): A video (16 minutes) that the attorney for CARD, Robert Morrill, made to describe the Roblejo prototype card shuffler. DVD sent to Examiner by US Postal Service with this PTO/SB/08 form.

DVD labeled Solberg Decl.Ex.C, which is not a video at all, is (see Binder 4-1, p. 34/206, Solberg Deck, para.8): Computer source code for operating a computer-controlled card shuffler (an early Roblejo prototype card shuffler) and Descriptive comments of how the code works. DVD sent to Examiner by US Postal Service with this PTO/SB/08 form.

Error Back propagation, http://willamelle.edu~gorr/classes/cs449/backprop.htm1(4 pages), Nov. 13, 2008.

European Communication pursuant to Article 94(3) EPC for European Application No. 15744793.9, dated Mar. 21, 2019, 5 pages.

(56) References Cited

OTHER PUBLICATIONS

European Examination Report for European Application No. 02780410, dated Aug. 9, 2011, 4 pages.
European Examination Report for European Application No. 07 853 071.4, dated Aug. 10, 2018, 7 pages.
European Examination Report for European Application No. 02780410, dated Jan. 25, 2010, 5 pages.
European Examination Report for European Patent Application No. 16168060.8, dated Feb. 22, 2018, 6 pages.
European Examination Report from European Application No. 17163607.9, dated Oct. 4, 2018, 3 pages.
European Extended Search Report and Written Opinion from European Application No. 18195983.4, dated Jan. 29, 2019, 10 pages.
European Extended Search Report from European Application No. 19209594.1, dated Feb. 28, 2020, 8 pages.
European Patent Application Search Report—European Patent Application No. 06772987.1, dated Dec. 10, 2009, 5 pages.
European Search and Opinion for European Application No. 19166074.5, dated Jul. 19, 2019, 7 pages.
European Search Report and Written Opinion from European Application No. 18199796.6, dated Apr. 5, 2019, 6 pages.
European Search Report for European Application No. 17163607.9 dated Sep. 15, 2017, 6 pages.
European Search Report for European Application No. 12152303, dated Apr. 16, 2012, 3 pages.
Fine, Randall A., "Talking Tables", dated Apr. 25, 2012. Global Gaming Business Magazine, vol. 11, No. 5, May 2012. Retrieved on Oct. 3, 2016 from the Internet: <URL: https://ggbmagazine.com/issue/vol-11-no-5-may-2012/article/talking-ables> (4 pages).
Genevieve Orr, CS-449: Neural Networks Willamette University, http://www.willamette.edu/~gorr/classes/cs449/intro.html (4 pages), Fall 1999.
Gola, Steve; Deposition; *Shuffle Tech International* v. *Scientific Games Corp., et al.* 1:15-cv-3702 (N.D. HL); Oct. 13, 2016; pp. 1, 9-21, 30-69, 150-167,186-188, 228-231, 290-315, 411; Henderson Legal Services, Inc.; Washington, DC.
Google search for card handling device with storage area, card removing system pivoting arm and processor., http://www.google.com/?tbm=pts&hl=en; Jul. 28, 2012.
Gros, Roger; New Card Management System to Be Tested at Bally's Park Place; Casino Journal; Apr. 1989; 5 pages.
http://www.ildado.com/casino_glossary.html, Feb. 1, 2001, p. 1-8.
https://web.archive.org/web/19991004000323/http://travelwizardtravel.com/majon.htm, Oct. 4, 1999, 2 pages.
http://www.google.com/search?tbm=pts&q=Card+handling+device+wilh+input+and-+outpu . . . , Jun. 8, 2012.
http://www.google.com/search?tbm=pts&q=shuffling+zone+onOopposite+site+of+input+ . . . Jul. 18, 2012.
I-Deal, Bally Technologies, Inc., (2014), 2 pages.
International Invitation to Pay Additional Fees and Partial Search Report for International Application PCT/US2019/048442, dated Dec. 6, 2019, 10 pages.
International Preliminary Report on Patenlabilily, for International Application No. PCT/US2019/027460, dated, Mar. 9, 2021, 10 pages.
International Preliminary Report on Patenlability Chapter 1 for PCT/US19/50436, dated Mar. 16, 2021, 8 pages.
International Search Report from International Application No. PCT/EP2017/073865, dated Mar. 2, 2018, 7 pages.
International Search Report from International Application No. PCT/US2019/027460, dated Aug. 12, 2019, 4 pages.
International Search Report from International Application No. PCT/US2019/048442, dated Jan. 28, 2020, 6 pages.
International Search Report from International Application No. PCT/US2019/050436, dated Dec. 12, 2019, 4 pages.
International Written Opinion from International Application No. PCT/EP2017/073865, dated Mar. 2, 2018, 12 pages.
International Written Opinion from International Application No. PCT/IB2017/055810, dated Jan. 8, 2018, 8 pages.
International Written Opinion from International Application No. PCT/US2019/027460, dated Aug. 12, 2019, 9 pages.
International Written Opinion from International Application No. PCT/US2019/048442, dated Jan. 28, 2020, 9 pages.
International Written Opinion from International Application No. PCT/US2019/050436, dated Dec. 12, 2019, 7 pages.
Lilwiller, Dave, CCD vs. CMOS: Facts and Fiction reprinted from Jan. 2001 Issue of Photonics Spectra, Laurin Publishing Co. Inc. (4 pages).
Macau Office Action and Search Report from Macau Application No. 1/1123, dated Feb. 14, 2019, 14 pages.
Macau Office Action and Search Report from Macau Application No. 1/1128, dated Dec. 27, 2018, 18 pages.
Macau Office Action and Search Report from Macau Application No. 1/1240, dated Aug. 15, 2018, 14 pages with English translation.
Malaysian Patent Application Substantive Examination Adverse Report—Malaysian Patent Application Serial No. PI 20062710, dated May 9, 2009, 4 pages.
NEON Product Information Datasheets [online]. "Enterprise Casino Management, Table Management System, Mobile Baming". Intelligent Gaming, 2014. Retrieved on Oct. 12, 2016 from the Internet: <URL: http://www.intelligentgaming.co.jk/products/neon-enterprise/> (4 pages).
Olsen, Eddie; Automatic Shuffler 'ready' for Atlantic City experiment; Blackjack Confidential; Jul./Aug. 1989; pp. 6-7.
PCT International Preliminary Examination Report for International Patent Application No. PCT/US02/31105 dated Jul. 28, 2004, 9 pages.
1/3 B/W CCD Camera Module EB100 by EverFocus Electronics Corp., Jul. 31, 2001, 3 pgs.
Ace, Single Deck Shuffler, Shuffle Master, Inc., (2005), 2 pages.
Australian Examination Report for Australian Application No. 2016277702, dated Jul. 12, 2018, 3 pages.
Australian Examination Report for Australian Application No. 2008202752, dated Sep. 25, 2009, 2 pages.
Australian Examination Report for Australian Application No. 2010202856, dated Aug. 11, 2011, 2 pages.
Australian Examination Report from Australian Application No. 2017204115, dated Dec. 20, 2018, 4 pages.
Australian Examination Report, for Australian Application No. 2016363815, dated Feb. 3, 2021, 4 pages, with English Translation.
Australian Provisional Patent Application for Australian Patent Application No. PM7441, filed Aug. 15, 1994, Applicants: Rodney G. Johnson et al., Tille: Card Handling Apparatus, 13 pages.
Automatic casino card shuffle, Alibaba.com, (last visited Jul. 22, 2014), 2 pages.
Bally Systems Catalogue, Ballytech.com/systems, 2012, 13 pages.
Canadian Office Action for CA 2,580,309 dated Mar. 20, 2012 (6 pages).
Canadian Office Action for Canadian Application No. 2,886,633, dated Nov. 1, 2018, 4 pages.
Canadian Office Action for Canadian Application No. 2,985,255 dated Jul. 25, 2019, 4 pages.
Canadian Office Action for Canadian Application No. 3,033,280, dated Apr. 14, 2021, 4 pages.
Canadian Office Action for Canadian Application No. 2,461,726, dated Dec. 11, 2013, 3 pages.
Canadian Office Action for Canadian Application No. 2,461,726, dated Jul. 19, 2010, 3 pages.
Canadian Office Action from Canadian Application No. 2,823,738, dated Sep. 8, 2017, 4 pages.
Canadian Office Action from Canadian Application No. 2995664, dated Jun. 4, 2019, 5 pages.
CasinoTrac TableTrac Services. Product Information Dalasheet [online]. CasinoTrac, 2015. Retrieved on Oct. 12, 2016 from the Internet: <URL: http://www.tabletrac.com/?pageid=15#prettyPhoto> (3 pages).
Chinese First Office Action and Search Report from Chinese Application No. 201580027851.8, dated Mar. 4, 2019, 9 pages.
Chinese Office Action and Search Report from Chinese Application No. 201310361850.X, dated Oct. 10, 2018, 9 pages.
Chinese Search Report for Chinese Application No. 201580027851.8, dated Feb. 22, 2019, 1 page.

(56) References Cited

OTHER PUBLICATIONS

Christos Stergiou and Dimitrios Siganos, "Neural Networks," http://www.doc.ic.ac.uk/~nd/surprise_96/journal/vol4/cs11/report.html (13 pages), Dec. 15, 2011.
Complaint filed in the matter of *SHFL entertainment, In.* v. *DigiDeal Corporation*, U.S. District Court, District of Nevada, Civil Action No. CV 2:12-cv-01782-GMC-VCF, Oct. 10, 2012, 62 pages.
CONNECT2TABLE Administrator Manual, Jan. 7, 2013 (82 pages).
CONNECT2TABLE Connecl2Table System Summary, generated Oct. 21, 2016 (2 pages).
CONNECT2TABLE Quick Installation Guide, Feb. 20, 2013 (36 pages).
CONNECT2TABLE User Manual, Feb. 7, 2013 (35 pages).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 18 of 23 color copies from Binder 1).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 19 of 23 color copies from Binder 3).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 20 of 23 color copies from Binder 4).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of (color pages, for clarity, Part 22 of 23 color copies from Binder 8, part 1 of 2).
Documents submitted in case of *Shuffle Master, Inc.* v. *Card Aurstia, et al.*, Case No. CV-N-0508-HDM-(VPC) Consolidated with Case No. CV-N-02-0244-ERC-(RAM)), May 6, 2003, scan of color pages, for clarity, Part 23 of 23 (color copies from Binder 8, part 2 of 2).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 15 of 23 (Binder 8, 3 of 5).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 16 of 23 (Binder 8, 4 of 5).
Documents submitted in case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 17 of 23 (Binder 8, 5 of 5).
Documents submitted in case of *Shuffle Master, Inc.* v. *Card Austria, et al.*, Case No. CV-N-0508-HDM-(VPC) Consolidated with Case No. CV-N-02-0244-ERC-(RAM)), May 6, 2003, scan of (color pages, for clarity, Part 21 of 23 color copies from Binder 6).
Documents submitted in the case of *Shuffle Master, Inc.* v. *6Card Austria, et al.*, Case No. CV-N-0508-HDM-(VPC) (Consolidated with Case No. CV-N-02-0244-ERC-(RAM)), May 6, 2003, Part 7 of 23 (Binder 4, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 11 of 23 (Binder 7, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 12 of 23 (Binder 7, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 13 of 23 (Binder 8, 1 of 5).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 2 of 23 (Master Index and Binder 1, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 5 of 23 (Binder 3, 1 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 6 of 23 (Binder 3, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 8 of 23 (Binder 4, 2 of 2).
Documents submitted in the case of *Shuffle Master, Inc.* v. *Card Aurstia, et al.*, Case No. CV-N-0508-HDM-(VPC) (Consolidated with Case No. CV-N-02-0244-ERC-(RAM)), May 6, 2003, Part 9 of 23 (Binder 5 having no contents; Binder 6, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 1 of 23 (Master Index and Binder 1, 1 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 10 of 23 (Binder 6, 2 of 2).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 14 of 23 (Binder 8, 2 of 5).
Documents submitted in the case of *Shuffle Master, Inc.* v. *Card Austria, et al.*, Case No. CV-N-0508-HDM-(VPC) (Consolidated with Case No. CV-N-02-0244-ERC-(RAM)), May 6, 2003, Part 4 of 23 (Binder 2, 2 of 2).
hltp://www.ildado.com/casino_glossary.html, Feb. 1, 2001, p. 1-8.
hltps://web.archive.org/web/19991004000323/hltp://travelwizardtravel.com/majon.htm, Oct. 4, 1999, 2 pages.
Taiwanese Office Action and Search Report from Taiwanese Application No. 106133407, dated Sep. 4, 2018, 9 pages.
Tracking the Tables, by Jack Bularsky, Casino Journal, May 2004, vol. 17, No. 5, pp. 44-47.
TYM @ A Glance—Table Games Yield Management, TYM Live Product Information Datasheets [online]. TANGAM Systems, 2016. Retrieved on Oct. 3, 2016 from the Internet: <URL: http://tangamgaming.com/wp-content/uploads/2016/12/TG_TYMGlance_2016-V4-1.pdf> (2 pages).
United States Court of Appeals for the Federal Circuit Decision Decided Dec. 27, 2005 for Preliminary Injuction for *Shuffle Master, Inc.* vs. *VendingData Corporation*, In the U.S. District Court, District of Nevada, No. CV-S-04-1373-JCM-LRL.
VendingData Corporation's Answer and Counterclaim Jury Trial Demanded for *Shuffle Master, Inc.* vs. *VendingData Corporation*, In the U.S. District Court, District of Nevada, No. CV-S-04-1373-JCM-LRL, Oct. 25, 2004.
VendingData Corporation's Opposition to Shuffle Master Inc.'s Motion for Preliminary Injection for *Shuffle Master, Inc.* vs. *VendingData Corporation*, In the U.S. District Court, District of Nevada, No. CV-S-04-1373-JCM-LRL, Nov. 12, 2004.
VendingData Corporation's Responses to Shuffle Master, inc.'s First set of interrogatories for *Shuffler Master, Inc.* vs. *VendingData Corporation*, In the U.S. District Court, District of Nevada, No. CV-S-04-1373-JCM-LRL, Mar. 14, 2005.
Weisenfeld, Bernie; Inventor betting on shuffler; Courier-Post; Sep. 11, 1990; 1 page.
PCT International Search Report and Written Opinion for International Application No. PCT/US2007/022858, dated Mar. 7, 2008, 7 pages.
PCT International Search Report and Written Opinion for International Application No. PCT/US2007/023168, dated Sep. 12, 2008, 8 pages.
PCT International Search Report and Written Opinion for International Patent Application No. PCT/US2006/22911, dated Jun. 1, 2007, 6 pages.

(56) References Cited

OTHER PUBLICATIONS

PCT International Search Report and Written Opinion for PCT/US07/15035, dated Sep. 29, 2008, 6 pages.
PCT International Search Report and Written Opinion for PCT/US07/15036, dated Sep. 23, 2008, 6 pages.
PCT International Search Report and Written Opinion of the International Searching Authority for PCT/GB2011/051978, dated Jan. 17, 2012, 11 pages.
PCT International Search Report and Written Opinion of the International Searching Authority for PCT/US2008/007069, dated Sep. 8, 2008, 10 pages.
PCT International Search Report and Written Opinion of the International Searching Authority for PCT/US2010/001032, dated Jun. 16, 2010, 11 pages.
PCT International Search Report and Written Opinion of the International Searching Authority for PCT/IB2013/001756, dated Jan. 10, 2014, 7 pages.
PCT International Search Report and Written Opinion of the International Searching Authority for PCT/US05/31400, dated Sep. 25, 2007, 12 pages.
PCT International Search Report and Written Opinion of the International Searching Authority for PCT/US11/59797, dated Mar. 27, 2012, 14 pages.
PCT International Search Report and Written Opinion of the International Searching Authority for PCT/US13/59665, dated Apr. 25, 2014, 21 pages.
PCT International Search Report and Written Opinion, PCT Application No. PCT/US2013/062391, dated Dec. 17, 2013, 13 pages.
PCT International Search Report and Written Opinion, PCT Application No. PCT/US2015/022158, dated Jun. 17, 2015, 13 pages.
PCT International Search Report and Written Opinion, PCT Application No. PCT/US2015/025420, dated Oct. 2, 2015, 15 pages.
PCT International Search Report and Written Opinion, PCT Application No. PCT/US2015/040196, dated Jan. 15, 2016, 20 pages.
PCT International Search Report and Written Opinion, PCT Application No. PCT/US2015/051038, dated Jan. 22, 2016, 11 pages.
PCT International Search Report and Written Opinion, PCT/US2012/48706, dated Oct. 16, 2012, 12 pages.
PCT International Search Report for International Application No. PCT/US2007/022858, dated Apr. 18, 2008.
PCT International Search Report for International Application No. PCT/US2003/015393, dated Oct. 6, 2003, 2 pages.
PCT International Search Report for PCT/US2005/034737 dated Apr. 7, 2006 (WO06/039308).
PCT International Search Report for PCT/US2007/022894, dated Jun. 11, 2008, 3 pages.
Philippines Office Action, for Philippines Application No. 1/2018/501139, dated Apr. 8, 2021, 3 pages.
Philippines Patent Application Formality Examination Report—Philippines Patent Application No. 1-2006-000302, dated Jun. 13, 2006.
Playtech Retail begins roll out of Neon across Grosvenos 55 UK Casinos . Playtech, Apr. 21, 2016. Retneved on Oct. 11, 2016 from the Internet:<URL:https://www.playtech.com/news/latest_news_and_prs/playtech_retail_begins_roll_out_of_neon_across_grosvenor_s_55_uk_casinos>(1 page).
Press Release for Alliance Gaming Corp., Jul. 26, 2004—Alliance Gaming Announces Control with Galaxy Macau for New MindPlay Baccarat Table Technology, 2 pages, http://biz.yahoo.com/prnews.
Prototype Glossary and Timelines; *Shuffle Tech International* v. *Scientific Games Corp., et al.* 1:15-cv-3702 (N.D. III.); (May 2017) pp. 1-4.
Scame's Encyclopedia of Games by John Scame, 1973, "Super Contract Bridge", p. 153.
Service Manual/User Manual for Single Deck Shufflers: BG1, BG2 and BG3 by Shuffle Master (copyright) 1997, 151 page.
SHFL Entertainment, Inc. Docket No. 60, Opening Claim Construction Brief, filed in Nevada District Court Case No. 2:12-cv-01782 with exhibits, Aug. 8, 2013, p. 1-125.
Shuffle Master Gaming, Service Manual, ACE(trademark) Single Deck Card Shuffler, (1998), 63 pages.
Shuffle Master Gaming, Service Manual, Let It Ride Bonus (Register) With Universal Keypad, 112 pages, (Copyright) 2000 Shuffle Master, Inc.
Shuffle Master's Reply Memorandum in Support of Shuffle Master's Motion for Preliminary Injunction for *Shuffle Master, Inc.* vs. *VendingData Corporation*, In the U.S. District Court, District of Nevada, No. CV-S-04-1373-JCM-LRL, Nov. 29, 2004.
Shuffle Master, Inc. (1996) Let It Ride, The Tournament, User Guide, 72 pages.
*Shuffle Tech International LLC et al.* vs. *Scientific Games Corporation et al.*, Order Denying Motion for Summary Judgement: Memorandum Opinion and Order, In the U.S. District Court, For the Northern District of Illinois Eastern Division, No. 15 C 3702, Sep. 1, 2017, 35 pages.
Shufflers—SHFL entertainment, Gaming Concepts Group, (2012), 6 pages.
Singapore Patent Application Examination Report—Singapore Patent Application No. SE 2008 01914 A, Jun. 18, 2008, 9 pages.
Solberg, Halvard; Deposition; *Shuffle Tech International* v. *Scientific Games Corp., et al.* 1:15-cv-3702 (N.D. HL); Oct. 18, 2016; pp. 187, 224-246, 326-330, 338-339, 396; Baytowne Reporting; Panama City, FL.
Specification of Australian Patent Application No. 31577/95 filed Jan. 17, 1995, Applicants: Rodney G. Johnson et al.; Card Handling Apparatus.
Statement of Relevance of Cited References, Submitted as Part of a Third-Party Submission Under 37 CFR 1.290 on Dec. 7, 2012 (12 pages).
TableScanner "Accounting & Cage". Product Information Datasheets [online]. Advansys, 2013, Retrived on Oct. 11, 2016 from the Internet: <URL: http:/advansys.si/products/tablescanner/accounting-cage/> (4 pages).
TableScanner "Casino Management System", Product Information Datasheets [online]. Advansys, 2013. Retrieved on Oct. 11, 2016 from the Internet: <URL: http://advansys.si/> (6 pages).
TableScanner "Multisite", Product Information Datasheets [online]. Advansys, 2013. Retrieved on Oct. 11, 2016 from the Internet: <URL: http://advansys.si/products/tablescanner/multisite/> (3 pages).
TableScanner "Player Tracking", Product Information Datasheets [online]. Advansys, 2013. Retrieved on Sep. 23, 2016 from the Internet: <URL: http://advansys.si/products/tablescanner/player-tracking/> (4 pages).
TableScanner "Table Management system", Product Information Datasheets [online]. Advansys, 2013. Retrieved on Oct. 11, 2016 from the Internet: <URL: http://advansys.si/products/tablescanner/> (4 pages).
TableScanner (TM) from Advansys, Casino Inside Magazine, No. 30, pp. 34-36 (Dec. 2012) (4 pages).
TAG Archives: Shuffle Machine, Gee Wiz Online, (Mar. 25, 2013), 4 pages.
Taiwanese Office Action and Search Report for TW 106131789, dated Mar. 30, 2021, 19 pages (including English translation).
Taiwanese Office Action and Search Report from Taiwanese Application No. 10410643, dated Oct. 4, 2018, 15 pages.
Taiwanese Office Action and Search Report from Taiwanese Application No. 104122818, dated Apr. 29, 2019, 17 pages.

400

Manage | Floor View | View Reports | Administrator

Pit Section Table Device Remove Device

| Serial Number | Device Name | Status | Table Connected | Latest Alert |
|---|---|---|---|---|
| RLT-001 | Roulette | Online | RLT_01 | |
| RLT-002 | Roulette | Online | RLT_02 | |
| CSL-0201 | Chipstar | Offline | | |
| OTS-0101 | One2Six-SingleDeck | Online | OTS_SD_1 | |
| OTS-0102 | One2Six-SingleDeck | Online | OTS_SD_2 | |
| CSL-0301 | Chipstar | Online | RLT_01 | |
| CSL-0302 | Chipstar | Online | RLT_02 | |
| OTS-0201 | One2Six-SingleDeck | Online | OTS_MD_1 | |
| OTS-0202 | One2Six-SingleDeck | Online | OTS_MD_2 | Double Click on "LATEST ALERT" Column to see more errors. |
| MD3-0401 | MD3 | Online | MD3_01 | 8/18/2016 7:08:42 Pm. Invalid Deck(s) Missing:(1)4D,(1)7H,(1)3H,(1)AD |
| MD3-0402 | MD3 | Online | MD3_02 | 8/18/2016 7:08:42 Pm. Invalid Deck(s) Missing:(1)4D,(1)7H,(1)3H,(1)AD |
| DM2-0801 | DeckMate2 | Online | DM2_01 | 8/18/2016 7:08:42 Pm. Invalid Deck(s) Missing:(1)4D,(1)7H,(1)3H,(1)AD |
| DM2-0802 | DeckMate2 | Online | DM2_02 | 8/18/2016 7:08:42 Pm. Invalid Deck(s) Missing:(1)4D,(1)7H,(1)3H,(1)AD |
| IDP-0501 | IDealPlus | Online | IDP_01 | 8/18/2016 7:08:42 Pm. Invalid Deck(s) Missing:(1)4D,(1)7H,(1)3H,(1)AD |
| IDP-0502 | IDealPlus | Online | IDP_02 | 8/18/2016 7:08:42 Pm. Invalid Deck(s) Missing:(1)4D,(1)7H,(1)3H,(1)AD |
| ISHOE-0601 | IShoeAuto | Online | ISA_01 | 8/18/2016 7:08:42 Pm. Invalid Deck(s) Missing:(1)4D,(1)7H,(1)3H,(1)AD |
| ISHOE-0602 | IShoeAuto | Online | ISA_02 | 8/18/2016 7:08:42 Pm. Invalid Deck(s) Missing:(1)4D,(1)7H,(1)3H,(1)AD |
| SBSHO-0701 | SAFEBACCSHOE | Online | SBS_01 | 8/18/2016 7:08:42 Pm. Invalid Deck(s) Missing:(1)4D,(1)7H,(1)3H,(1)AD |
| SBSHO-0702 | SAFEBACCSHOE | Online | SBS_02 | 8/18/2016 7:08:42 Pm. Invalid Deck(s) Missing:(1)4D,(1)7H,(1)3H,(1)AD |

440

FIG. 4C

DEVICES, SYSTEMS, AND RELATED METHODS FOR REAL-TIME MONITORING AND DISPLAY OF RELATED DATA FOR CASINO GAMING DEVICES

CROSS-REFERENCE TO RELATED APPLICATIONS

This application is a continuation of U.S. patent application Ser. No. 16/409,996, filed May 13, 2019, now U.S. Pat. No. 10,885,748, issued Jan. 5, 2021, which is a continuation of U.S. patent application Ser. No. 15/276,476, filed Sep. 26, 2016, now U.S. Pat. No. 10,339,765, issued Jul. 2, 2019, the disclosure of which is hereby incorporated herein in its entirety by this reference. This application is also related to U.S. patent application Ser. No. 15/096,473, filed Apr. 12, 2016, now U.S. Pat. No. 10,343,054, issued on Jul. 9, 2019, which is a continuation of U.S. patent application Ser. No. 14/137,557 filed Dec. 20, 2013, now U.S. Pat. No. 9,345,951, issued May 24, 2016, which is a continuation of U.S. patent application Ser. No. 11/558,818, filed on Nov. 10, 2006, now U.S. Pat. No. 8,616,552, issued Dec. 31, 2013, which is a continuation-in-part of U.S. patent application Ser. No. 09/967,500, filed Sep. 28, 2001, now U.S. Pat. No. 8,337,296, issued Dec. 25, 2012, the disclosure of each of which is hereby incorporated herein in its entirety by this reference. The present application is also related to U.S. patent application Ser. No. 14/549,301, filed Nov. 20, 2014, now U.S. Pat. No. 9,320,964, issued Apr. 26, 2016, which is a continuation of U.S. patent application Ser. No. 13/632,875, filed Oct. 1, 2012, now U.S. Pat. No. 8,919,775, issued Dec. 30, 2014, which is a continuation-in-part of U.S. patent application Ser. No. 11/558,818, filed Nov. 10, 2006, now U.S. Pat. No. 8,616,552, issued Dec. 31, 2013, the disclosure of each of which is hereby incorporated herein in its entirety by this reference.

TECHNICAL FIELD

The present disclosure relates to casino gaming devices and, more specifically, to casino gaming devices in a communications network and related methods for real-time monitoring of the casino gaming devices.

BACKGROUND

Electronic devices used in the gaming industry are well known to be used for increasing the efficiency, security and game speed of various casino wagering games. For example, card handling devices (e.g., automatic card shufflers) may be used in live table games to perform a variety of functions, including randomly shuffling one or more decks of playing cards in an efficient and thorough manner to reduce delay during game play as well as between rounds. Card handling devices may also help to prevent players from having an advantage by knowing the position of specific cards or groups of cards in the final arrangement of cards delivered in the play of the game. Card handling devices may also include card recognition systems that verify contents of the deck and recognize the rank and suits of cards dispensed by the card handling device during game play. Other casino gaming devices may include gaming tables that include player interfaces for displaying virtual cards, displaying virtual chips for betting, receiving player inputs for entering game commands, etc. In some embodiments, gaming tables may employ a combination of physical and virtual features. For example, some gaming tables may include touch screen displays to manage some game features while also using traditional physical objects, such as physical wagering chips and/or physical playing cards. Some gaming tables include bet sensors integrated into the gaming table to detect the presence of physical wagers, side wagers, etc., in the form of chips or tokens and, in some situations, may even detect the value of the various wagers. Other casino gaming devices (e.g., roulette) may also include physical and/or virtual elements to game play.

As a result, some of the casino gaming devices may employ human control and direction during game play, such as by a card dealer or other game operator. Casino personnel often stand next to the gaming tables to observe game play to monitor game flow and outcomes. Casinos and casino personnel are very busy; therefore, efficiency of the gaming devices may help to reduce the time spent by casino personnel in monitoring these devices in order to allow the casino personnel to attend to other issues elsewhere in the casino. Some systems have used network architectures to gather data from the casino gaming devices, such as to assist in monitoring and/or in generating use-based billing for casinos that lease the devices. These conventional systems, however, have been somewhat limited in the information and presentation of data to the casino personnel.

BRIEF SUMMARY

An embodiment of the present disclosure includes a monitoring system in an environment including a plurality of casino table games which have associated, electronic card handling devices each adapted to generate card handling performance data and a communication network. The monitoring system comprises a monitoring server in communication with the network and programmed to receive the card handling performance data from the card handling devices, the performance data selected from the group consisting of one or more of shuffling data, game hand data, card dealing/distribution data, game round data, and game outcome data; and an operator station in communication with the monitoring server and including a user input device and a video display. At least one of the monitoring server or the operator station is configured to associate each card handling devices received performance data with the data generating device, and control the operator station video display to display a graphical user interface including for each of at least two casino table games graphical representations of the selected performance data.

Another embodiment includes a method of gathering and maintaining operational performance indicators for a plurality of casino table devices operably coupled to a casino network including a middleware server and a client terminal. The method comprises each of the plurality of table devices generating associated operational performance indicators, storing the operational performance indicators gathered from the plurality of table devices at the middleware server, in response to receiving a request from the client terminal at the middleware server, generating a response data set including at least some of the operational performance indicators related to at least one of the plurality of table devices, and transmitting the response data set to the requesting client terminal, and processing and presenting the response data set at one or more output devices of the client terminal.

BRIEF DESCRIPTION OF THE DRAWINGS

FIGS. 4A-4H illustrate a graphical user interface having a dashboard view for various graphical elements that may be generated and displayed by the operator station using the game data stored in the game operation database of the monitoring server.

DETAILED DESCRIPTION

Figure 1:
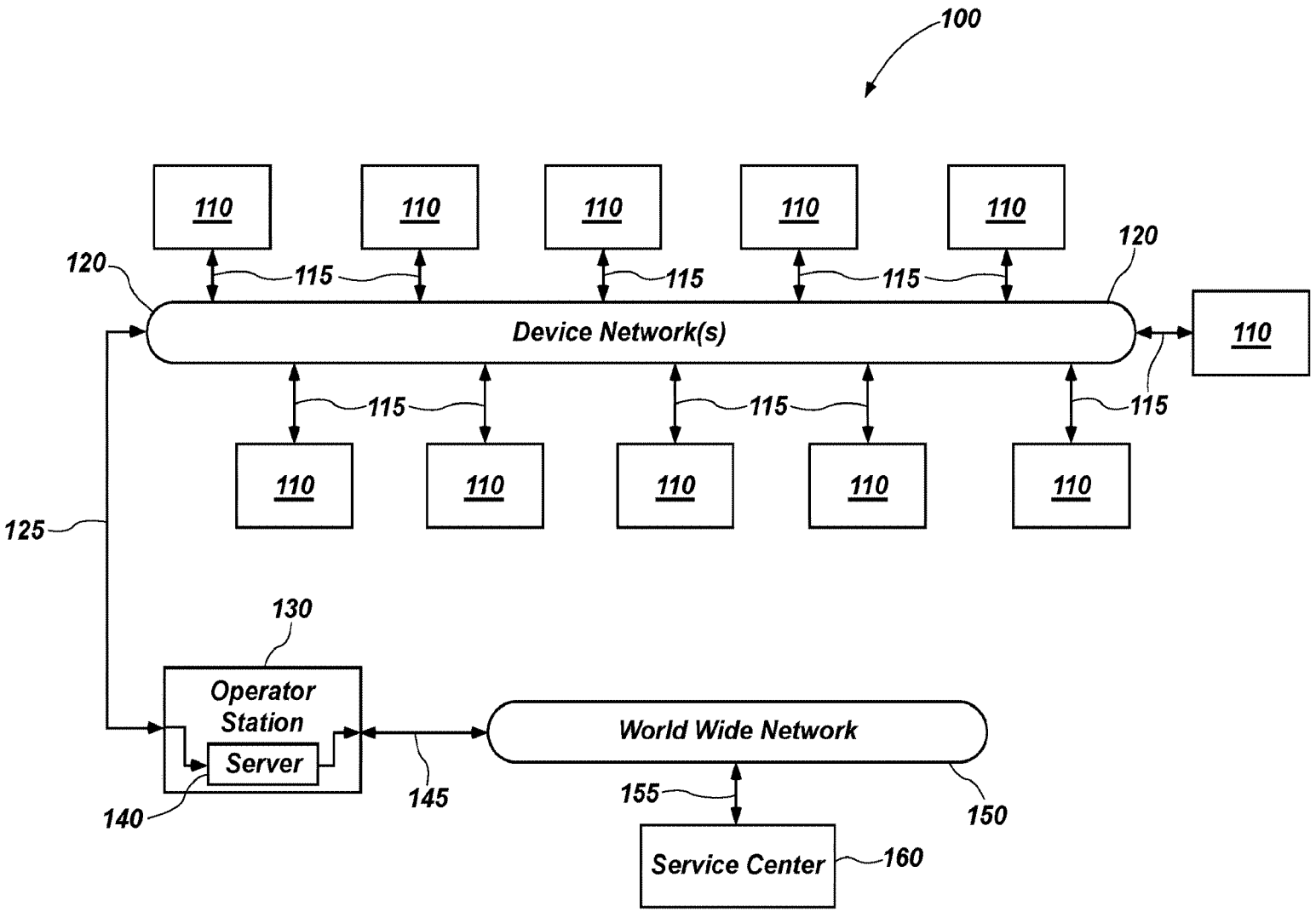
FIG. 1 is a schematic block diagram of a casino gaming device monitoring system according to an embodiment of the present disclosure.

In the following detailed description, reference is made to the accompanying drawings that form a part hereof, and in which is illustrated specific embodiments in which the disclosure may be practiced. These embodiments are described in sufficient detail to enable those of ordinary skill in the art to practice the disclosure. It should be understood, however, that the detailed description and the specific examples, while indicating examples of embodiments of the disclosure, are given by way of illustration only and not by way of limitation. From this disclosure, various substitutions, modifications, additions, rearrangements, or combinations thereof within the scope of the disclosure may be made and will become apparent to those of ordinary skill in the art.

The illustrations presented herein are not meant to be actual views of any particular apparatus (e.g., device, system, etc.) or method, but are merely idealized representations that are employed to describe various embodiments of the disclosure. Accordingly, some of the drawings may be simplified for clarity. Thus, the drawings may not depict all of the components of a given apparatus (e.g., device) or all operations of a particular method. In addition, like reference numerals may be used to denote like features throughout the specification and figures.

Information and signals described herein may be represented using any of a variety of different technologies and techniques. For example, data, instructions, commands, information, signals, bits, symbols, and chips that may be referenced throughout the description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the disclosure may be implemented on any number of data signals including a single data signal.

The various illustrative logical blocks, modules, circuits, and algorithm acts described in connection with embodiments disclosed herein may be implemented or performed with a general-purpose processor, a special-purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein.

A processor herein may be any processor, controller, microcontroller, or state machine suitable for carrying out processes of the disclosure. A processor may also be implemented as a combination of computing devices, such as a combination of a DSP and a microprocessor, a plurality of microprocessors, one or more microprocessors in conjunction with a DSP core, or any other such configuration. When configured according to embodiments of the disclosure, a special-purpose computer improves the function of a computer because, absent the disclosure, the computer would not be able to carry out the processes of the disclosure. The disclosure also provides meaningful limitations in one or more particular technical environments that go beyond an abstract idea. For example, embodiments include features that improve the functionality of such monitoring systems used in the gaming industry. Thus, a new system, device, and method for monitoring casino gaming devices are described. As a result, embodiments of the present disclosure provide improvements in the technical field of networked gaming devices and related monitoring systems.

In addition, it is noted that the embodiments may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, interfacing with an operating system, etc. Furthermore, the methods disclosed herein may be implemented in hardware, software, or both. If implemented in software, the functions may be stored or transmitted as one or more instructions (e.g., software code, firmware, etc.) on a computer-readable medium. Computer-readable media includes both computer storage media and communication media including any medium that facilitates transfer of a computer program from one place to another.

FIG. 1 is a schematic block diagram of a casino gaming device monitoring system 100 (hereinafter referred to as "monitoring system 100") according to an embodiment of the present disclosure. The monitoring system 100 includes a plurality of casino gaming devices 110. The casino gaming devices 110 may be located on a casino floor for facilitating play of one or more different casino wagering games (e.g., card games, roulette, etc.). Each casino gaming device 110 is operably coupled to one or more device networks 120 (e.g., via corresponding communication links 115). The monitoring system 100 may further include a monitoring server 140 that is operably coupled with the one or more device networks 120 (e.g., via communication link 125). Data stored in the monitoring server 140 may be accessible by an operator station 130. In some embodiments, the monitoring server 140 may be located within the operator station 130 (e.g., as shown in FIG. 5). In some embodiments, the operator station 130 and the monitoring server 140 may be located separate from each other. The monitoring server 140 may also be referred to as "utility server" or "middleware server." The operator station 130 may also be referred to as a "client terminal."

In some embodiments, the operator station 130 and the monitoring server 140 may be located within the casino property, whereas in other embodiments the operator station 130 and/or monitoring server 140 may be located remote from the casino property. In an embodiment in which either the operator station 130 and/or the monitoring server 140 are located remote from the casino property, the operator station 130 and the monitoring server 140 may still be operated and administered by casino personnel. In some embodiments, the monitoring system 100 may further include a service center 160 operably coupled (e.g., via communication links 145, 155 over a world wide network 150) to the monitoring server 140. The service center 160 may also be located either on the casino property or at a remote location. In some embodiments, the service center 160 and/or operator station 130 and monitoring server 140 may service gaming devices 110 at geographically different casinos. The communication links 115, 125, 145, 155 may include any form of wireless or wired connections, or any combination thereof.

The casino gaming devices 110 may include network-compatible casino gaming devices. For example, the casino gaming devices 110 may include one or more card handling devices (e.g., electro-mechanical smart card shufflers such as described in Wadds, et al., Ser. No. 14/549,301 filed Nov. 20, 2014 and titled "System for Billing Usage of a Card Handling Device" and electronic card handling and reading card shoes such as described in Grauzer, et al., U.S. Pat. No. 8,511,684 filed Jan. 16, 2009 and titled "Card-reading Shoe with Inventory Correction Feature and methods of Correcting Inventory," the disclosures of each which are hereby incorporated herein in its entirety by this reference), electronic gaming tables, roulette tables, progressive support equipment such as meters and displays and combinations thereof. In addition, sub-components of such devices may also be network-compatible, such as individual player stations, wagering sensors, dealer stations, game operator stations, a dolly sensor, roulette wheels, chip sorters, chip dispensers, etc.

Each individual casino gaming device 110 may be configured to be uniquely identified according to one or more unique identifiers assigned thereto. The unique identifiers may be encrypted and stored within memory of the casino gaming device 110 and/or within an associated memory device. For example, an external memory device may be mounted to a gaming table and connected to the casino gaming device 110. In some embodiments, the unique identifier may be unique as to the casino gaming device itself as a device identifier (e.g., device serial number or a unique network interface identifier). For example, if the casino gaming device 110 is a shuffler, the identifier may be a shuffler identifier. If the casino gaming device 110 is a gaming table, the identifier may be a table identifier, and so on. In some embodiments, the unique identifier may be assigned to all devices at a specific station. For example, the shuffler, sensors, etc., at a single gaming table may all be assigned the same table identifier. Each casino gaming device 110 may also be assigned additional identifiers, such as having a pit name that is shared with other casino gaming devices 110 located within the same pit, or having a section name that is shared with a subset of casino gaming devices 110 located within the a section of the same pit. An additional identifier may include a game identifier that is used to identify which wagering game is currently assigned to the casino gaming device 110. The messaging protocol between the gaming devices 110 and the casino network 120 may include message headers identifying the gaming device 110 (or each reporting component), and/or other identifiers such as a table identifier, a location reference and a casino property reference.

The monitoring server 140 may be configured to identify each individual casino gaming device 110 based on the unique identifier(s) assigned to the different casino gaming devices 110 coupled thereto. For example, during installation of the casino gaming devices 110 the casino gaming device 110 may retrieve the unique identifier and transmit the unique identifier to the monitoring server 140. The casino gaming devices 110 may also be configured to retrieve and transmit the unique identifiers to the monitoring server 140 at other instances, such as power up or other triggering events. In some embodiments, the monitoring server 140 may be configured to assign Internet Protocol (IP) addresses to the different casino gaming device 110 responsive to receiving a unique identifier therefrom.

The monitoring server 140 and the casino gaming devices 110 may be configured to communicate with each other via one or more different protocol formats. For example, some casino gaming devices 110 may communicate over a first protocol, whereas other casino gaming devices 110 may communicate over a second protocol. As a result, the monitoring server 140 may be configured to communicate with different types of casino gaming devices 110 (e.g., gaming tables, card shufflers, roulette tables, etc.) at the same time, which may also be produced by different gaming device manufacturers.

The monitoring server 140 may further be configured to receive operational performance data (i.e., game data) from all devices in real-time during operation thereof and perform real-time analysis on the operational data. The monitoring server 140 may also create and manage a game operation database 142 (FIG. 3) stored therein that receives the game data available from the various casino gaming devices 110. The monitoring server 140 may identify the data type of the received game data to determine how to handle the received game data for writing into the pre-defined database sections.

For card handling devices 110, the game data collected by the card handling device 110 and transmitted to the monitoring server 140 may include shuffling data, game hand data, card dealing/distribution data, game round data, game outcome data, and combinations thereof. The card handling devices 110 may be used for different types of card games. For example, the card handling device 110 may be configured to facilitate play of house-banked card games or other forms of card games. For roulette devices, the game data may include spin data, outcome data, and combinations thereof. In some embodiments, additional data such as wager data and player data may also be collected and transmitted to the monitoring server 140 by various casino gaming devices and/or sub-components thereof.

The operator station 130 may be configured to generate and display various reports in real-time based on the game data stored in the game operation database 142 of the monitoring server 140 in order to assist casino personnel to improve yield and productivity of the casino gaming devices 110. The game operation database 142 may also be made available for integration with other table management systems within the casino and/or third party systems, wherein the game data may be used for player tracking, determining player proficiency or possible irregular or improper play events, game optimization, game reports, table reports, dealer performance reports, utilization reports, service schedules, and combinations thereof. Optionally, the operator station 130 may also analyze the game data to generate real-time alerts to casino management (optional) and/or the service center 160 in the event of detection of any service outages or other irregularities.

An administrator may be provided with administrator access to the monitoring server 140 and its game operation database 142. Administrator access may be granted using the operator station 130 via the local casino network and/or through remote access through a remote device connected via the world wide network 150. The administrator access may permit the administrator to perform certain tasks, such as to assign casino gaming devices 110 to different gaming tables, set regular intervals for the monitoring server 140 to receive game data from the casino gaming devices 110, and/or define time periods (e.g., daily, weekly, etc.) for generating long term reports based on the game data. In some embodiments, the administrator may set chip values accepted for the different wagering games supported by the casino gaming devices 110.

An operator (e.g., a pit manager) may be provided with user access to the monitoring server 140 and its game operation database 142. User access may be granted using the operator station 130 via the local casino network and/or through remote access through a remote device connected via the world wide network 150. The user access may permit the operator perform certain tasks, such as viewing real-time reports displayed by the operator station 130. Long term reports may also be generated and displayed by the operator station 130.

For card handling devices 110, the reports may include total rounds per hour, total player hands dealt per hour, average players per round per hour, revenue per hour, wager values for individual players as well as for all players serviced by a particular gaming device 110. Such reports may be generated and viewable for each individual card handling device 110 or reporting component thereof. As a result, a report for each individual card handling device 110 may be viewable simultaneously for the operator to compare real-time performance across the entire network of card handling devices 110. In some embodiments, the game data may be aggregated across all card handling devices 110 of the device network 120 to generate and display the rounds per hour, player hands per hour, average players per round per hour, and revenue per hour in the aggregate for all card handling devices of the casino network and/or as an average across all card handling devices of the casino network. In some embodiments, reports may be generated that display comparisons of different card handling devices 110 against each other or the average values for all gaming devices 110 across the casino network 120. In each of these examples, an hour is used as the time period for measurement; however, other time periods are contemplated (e.g., 15 minutes).

For roulette gaming devices 110, the reports may include total number of spins per hour, revenue per hour, average players per spin per hour, wager values for individual players as well as for all players at a roulette table and outcomes. Such reports may be generated and viewable for each individual roulette gaming device 110. As a result, a report for each individual roulette gaming device 110 may be viewable simultaneously for the operator to compare real-time performance across the entire network of roulette gaming devices 110. In some embodiments, the game data may be aggregated across all roulette gaming devices 110 of the device network 120 to generate and display the spins per hour, revenue per hour, average players per spin per hour, wager values in the aggregate for all roulette gaming devices 110 of the casino network 120 and/or as an average across all roulette gaming devices 110 of the casino network 120. In some embodiments, reports may be generated that display comparisons of different roulette gaming devices 110 against each other or the average values for all roulette gaming devices 110 across the casino network 120. In each of these examples, an hour is used as the time period for measurement; however, other time periods are contemplated (e.g., 15 minutes).

Such reports of the different gaming devices 110 may be updated in real time on a dashboard view of a graphical user interface displaying the reports for all casino gaming devices 110 of the casino network 120. As a result, casino personnel may review profitability metrics of the casino gaming devices 110 simultaneously in order to improve table yield and determine irregularities in operation or performance. Logging the duration and intensity of use for each individual casino gaming device 110 may also be used by the casino personnel for setting service schedules, workforce schedules and gaming device 110 usage rotation to do so more efficiently.

In some embodiments, game outcomes may be reported to the monitoring server 140 and displayed to the operator station 130. For example, jackpot or progressive wins and other high value winning events may be reported to the monitoring server 140 after the round has finished for verification by the pit manager. In addition, during the session of an anonymous player (e.g., a player who is not identified by a player loyalty card), the player's average wager as well as the overall turnover during a specific time frame may be tracked, which may be used to identifying the anonymous player as a potential VIP.

Performance of some gaming devices 110 may also be monitored to detect irregularities such as, for example, dealer-player collusion, improper card counting, outcome biases and betting patterns which may suggest improper activities or the like. Algorithms may be applied to automatically flag gaming devices associated with such activities for detailed monitoring.

Figure 2:
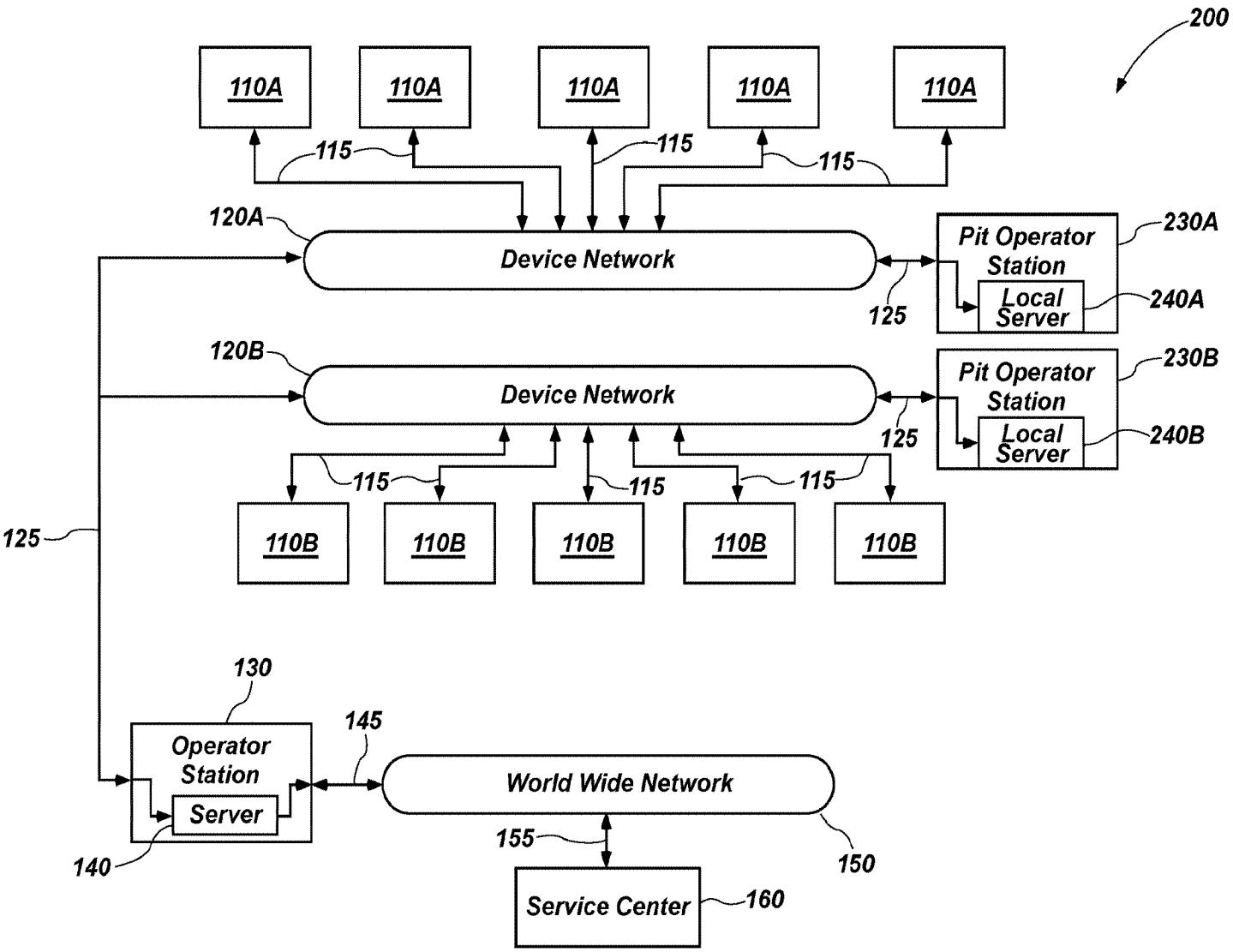
FIG. 2 is a schematic block diagram of a casino gaming device monitoring system according to another embodiment of the present disclosure.

FIG. 2 is a schematic block diagram of a casino gaming device monitoring system 200 (hereinafter referred to as "monitoring system 200") according to another embodiment of the present disclosure. The monitoring system 200 may include a plurality of casino gaming devices 110A, 110B located on a casino floor for facilitating play of one or more different casino wagering games (e.g., card games, roulette, etc.). Each casino gaming device 110A, 110B is operably coupled to one or more device networks 120A, 120B. For example, a first set of casino gaming devices 110A may be coupled to a first device network 120A, and a second set of casino gaming devices 110B may be coupled to a second device network 120B. The first set of casino gaming devices 110A may be configured to facilitate a first type of wagering game (e.g., a card game), and the second set of casino gaming devices 110B may be configured to facilitate a second type of wagering game (e.g., roulette).

In the embodiment of FIG. 2, the monitoring system 200 may further include additional operator stations 230A, 230B and local monitoring servers 240A, 240B. The first monitoring server 240A and corresponding first operator station 230A may be coupled to the first device network 120A to receive game data from the first set of casino gaming devices 110A. The second monitoring server 240B and corresponding second operator station 230B may be coupled to the second device network 120B to receive game data from the second set of casino gaming devices 110B. The monitoring system 200 may still include the monitoring server 140 as described in FIG. 1 to receive game data from the casino gaming devices 110A, 110B of the entire casino network so that all game data is accessible to simultaneously to a single operator. The embodiment of FIG. 2 differs from FIG. 1 in that it also enables local pit operators to have a limited subset of the data for a particular group of casino gaming devices 110A, 110B. Each of the additional operator stations 230A, 230B may be configured to generate and display similar reports as discussed above, but limited to the specific casino gaming devices 110A, 110B connected to its respective device network 120A, 120B.

Figure 3:
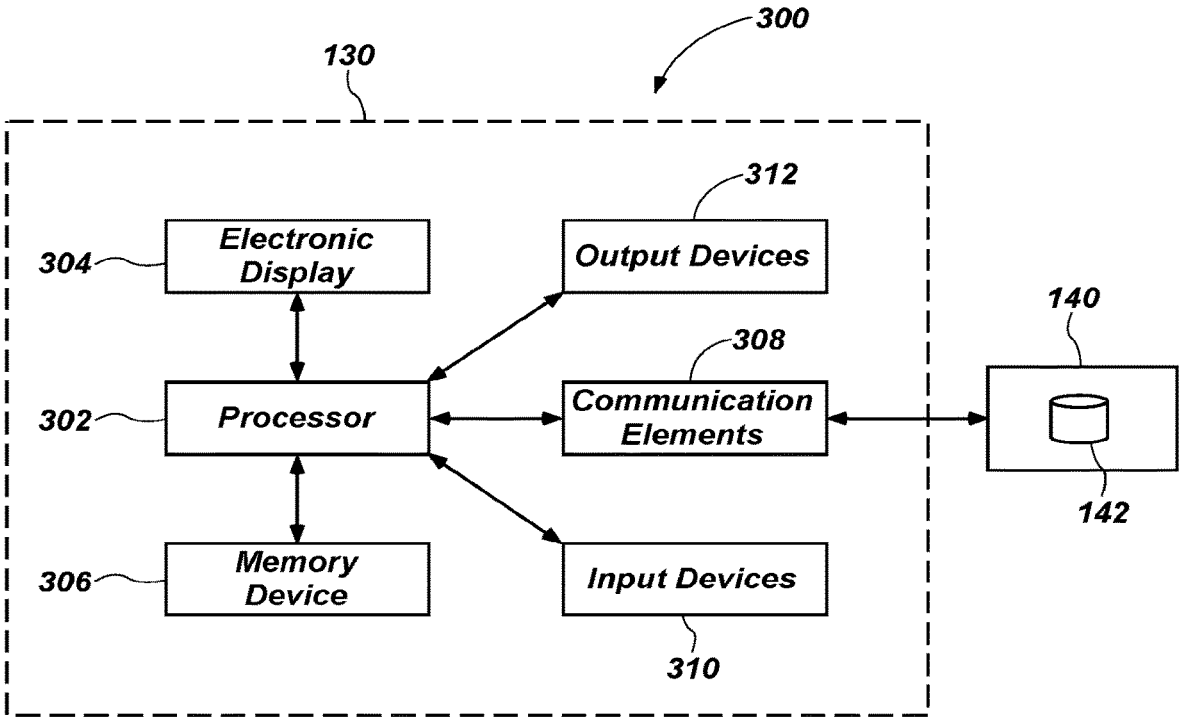
FIG. 3 is a schematic block diagram of the operator station and the monitoring server according to an embodiment of the present disclosure.

FIG. 3 is a schematic block diagram 300 of the operator station 130 and the monitoring server 140 according to an embodiment of the present disclosure. The operator station 130 includes a processor 302 operably coupled with an electronic video display 304, a memory device 306, communication elements 308, input devices 310 (e.g., mouse, keyboard, voice activation devices, etc.), and output devices 312 (e.g., printer). The video display 304 may include touch screen capability. The memory device 306 may include volatile and non-volatile storage memory, which may include computer-readable instructions (e.g., software, firmware, operating system, etc.) for the processor 302 to execute to perform the functions described herein. The operator station 130 may be a consumer electronic device, such as a desktop computer, a laptop computer, a tablet computer, a smart phone or other type of computing device. The monitoring server 140 may store the game operation database 142, from which the operator station 130 may retrieve the game operation data for generating and displaying real-time reports and other reports to monitor the operation, efficiency, etc., of the casino gaming device 110 and or the dealer.

As described above, the operator station 130 and the monitoring server 140 may be separate devices such that they communicate with each other through communication devices for external communication therebetween. In some embodiments, the operator station 130 and the monitoring server 140 may be integrally formed such that the monitoring server 140 is internal to the operator station 130 with the game operation database 142 stored in the memory device 306 or other storage medium within the operator station 130.

FIGS. 4A-4H illustrate a graphical user interface 400 having a dashboard view for various graphical elements that may be generated and displayed by the operator station 130 using the game data stored in the game operation database 142 of the monitoring server 140. In particular, FIGS. 4A-4H show different views and features that may be displayed by the graphical user interface 400 for monitoring operation of the casino gaming devices.

Figure 4A:
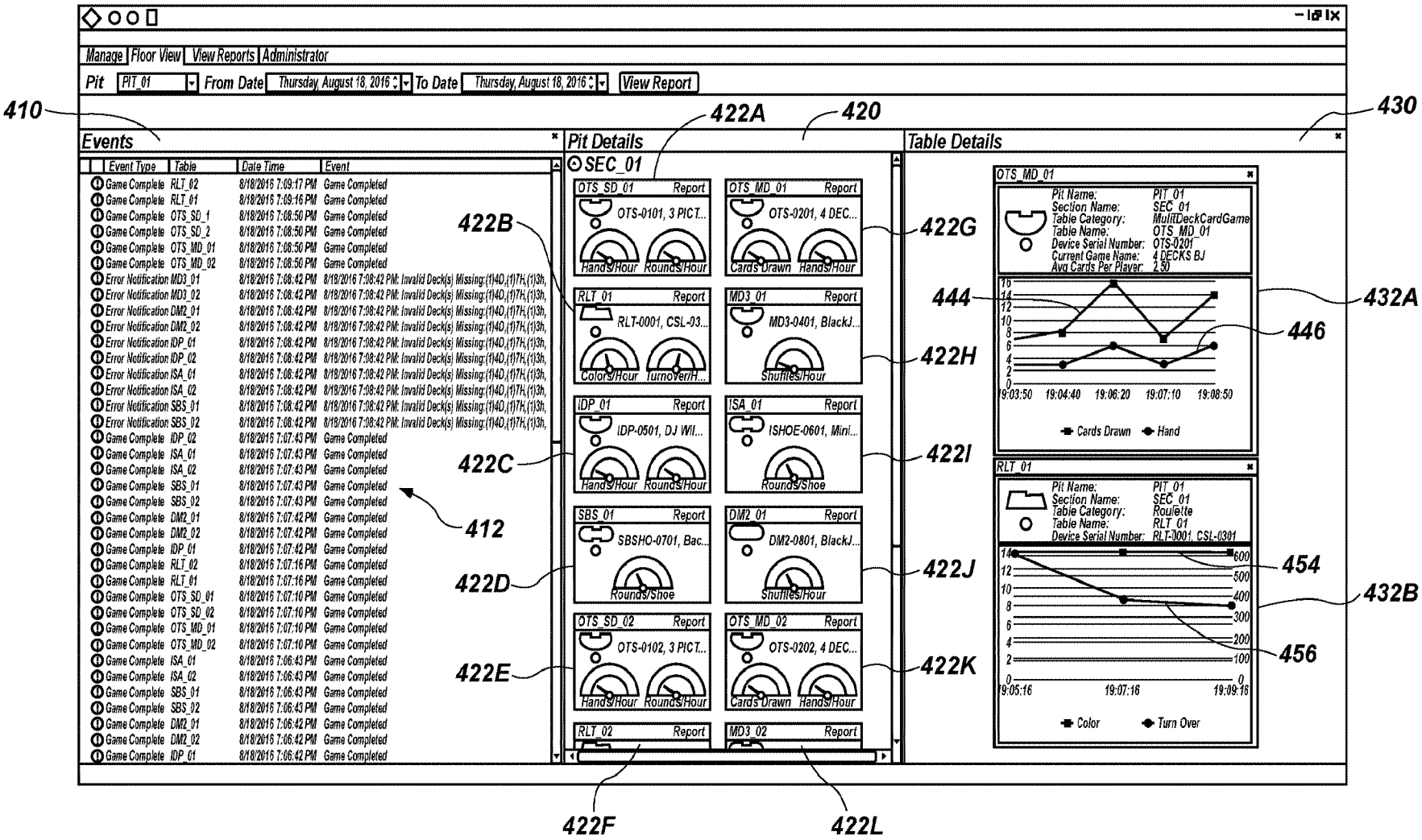
Figure 4B:
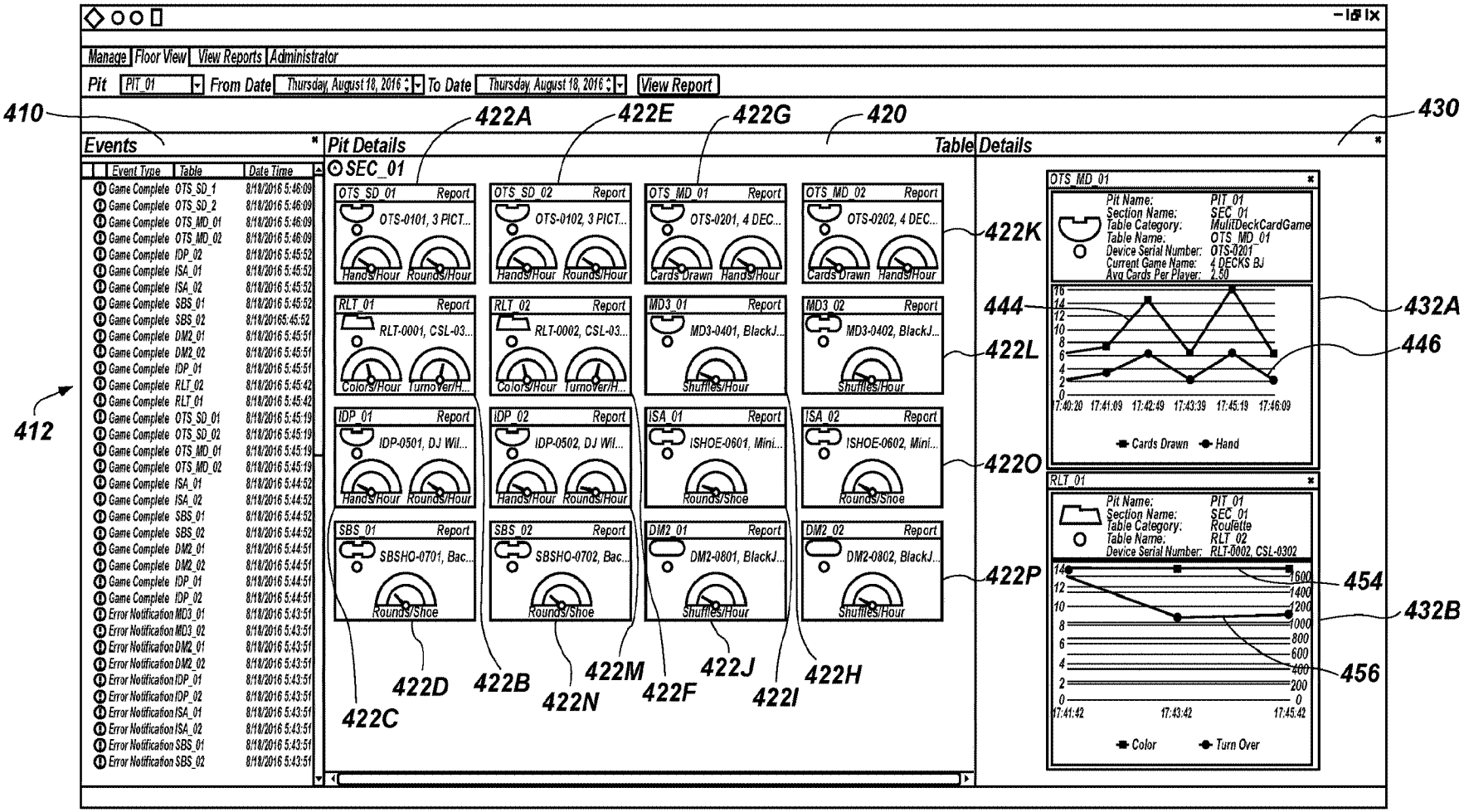

Referring specifically to FIGS. 4A and 4B, the graphical user interface 400 may include a real-time dashboard that presents updated game data in real time. The graphical user interface 400 may include an events area 410 that is configured to display one or more log entries for game events 412 for the different casino gaming devices 110. The graphical user interface 400 may also include a pit details area 420 that is configured to graphically display different operational rate graphics 422A-422L (FIG. 4A), 422A-422P (FIG. 4B) for the different casino gaming devices 110. The graphical user interface 400 may also include a table details area 430 that is configured to display different operational graphs 432A, 432B for the different casino gaming devices 110. These different areas 410, 420, 430 may be part of a floor view option offered by the graphical user interface 400 for providing information and reports for the casino gaming devices 110 that are grouped together on a particular floor (e.g., pit) of the casino.

In some embodiments, each of the events area 410, pit details area 420, and table details area 430 may be implemented as separate windows that may be adjusted (e.g., repositioned, resized, minimized, etc.) by the user. For example, as shown in FIG. 4B the pit details area 420 may be resized so that the operational rate graphics 422A-422L are rearranged within the pit details area 420 and additional operational rate graphics 422M-422P are viewable within the pit details area 420 without needing to scroll down as in the case of FIG. 4A. In some embodiments, one or more of the events area 410, pit details area 420, or table details area 430 may be embedded in the graphical user interface 400 such that its size and/or position may be fixed.

The events area 410 may be populated with log entries for game events 412 for the different casino gaming devices 110. As new events are completed, new log entries may be added in real-time to the events area 410. Each log entry may include an event type (e.g., game complete, error notification) that completed at a specific date and time (e.g., Aug. 18, 2016 at 8:09:17 PM) for a particular table defined by its unique table identifier (e.g., RLT_02, RLT_01, OTS_SD_1, etc.). The log entry may also include an event description (e.g., game complete, missing cards, invalid deck, etc.).

The pit details area 420 may be populated with different operational rate graphics 422A-422P for the different casino gaming devices 110. Each operational rate graphic 422A-422P may graphically depict an operational rate (e.g., as a meter, bar graph, etc.) in real-time for a particular casino gaming device 110. For example, a first operational rate graphic 422A may depict two operational rates for the hands per hour dealt by the card handling device 110 (e.g., shoe or shoe/shuffler) and the number of rounds per hour completed at the specific table defined by the table identifier OTS_SD_1. Likewise, a second operational rate graphic 422B may depict two operational rates for the colors per hour and the turnover per hour at the roulette table defined by the table identifier RLT_01. As used herein, "color" refers to a unique player at a roulette table as some roulette tables (e.g., particularly those that only allow wagers having one value) assign different color chips to the different players. The term "turnover" refers to the revenue received by the roulette table. The other operational rate graphics 422C-422P may similarly depict various operational rates that may be specifically tailored to the gaming device 110 type and/or game type assigned to a particular table. Additional operational rates may include, for example, cards drawn/hour, shuffles/hour, rounds/shoe, and other rates that indicate the efficiency of the device or dealer and/or the profitability of the gaming device 110.

The table details area 430 may include additional real-time reports 432A, 432B for individual tables within the pit. For example, a first real-time table report 432A may show the number of cards drawn (line 444) or the number of hands dealt (line 446) since the last real-time reading. The first real-time table report may also show table identifying information, such as the pit name, section name, table category, unique table name, device serial number, the current game being played, and the average card dealt per player for the game of blackjack (which is the current game being played in the example shown). As another example, a second real-time table report 432B may show the unique players (i.e., colors, line 454) playing a roulette game and the amount of turnover (i.e., revenue, line 456) since the last real-time reading.

During the real-time analysis, the operator station 130 may generate real-time management alerts to the casino personnel responsive to certain trends or thresholds being identified. For example, a potential VIP may be identified responsive to detecting an average bet from an individual player that exceeds a predetermined threshold. As a result, a manager may be alerted regarding the existence of a potential VIP. In addition, an alert may be generated if there exists a deviation over a predetermined target roulette game spin rate, a target table game round rate, etc. In some embodiments, an alert may be generated to casino personnel to recommend opening a new table based on the real-time usage of the various tables in the pit. In other embodiments, the real-time data may be analyzed to calculate the theoretical win rate (e.g., turnover multiplied by the house edge) to compare with the actual results to generate an alert if the actual win rate deviates from the theoretical win rate substantially over time.

Additional outcome data may also be captured by the card handling devices 110 employing card recognition systems to track individual cards and hands that are dealt. Such data may also be compared to determine if the dealt hands (e.g., royal flush, full house, etc.) deviate substantially from the theoretical rate for the winning hands.

Figure 4D:
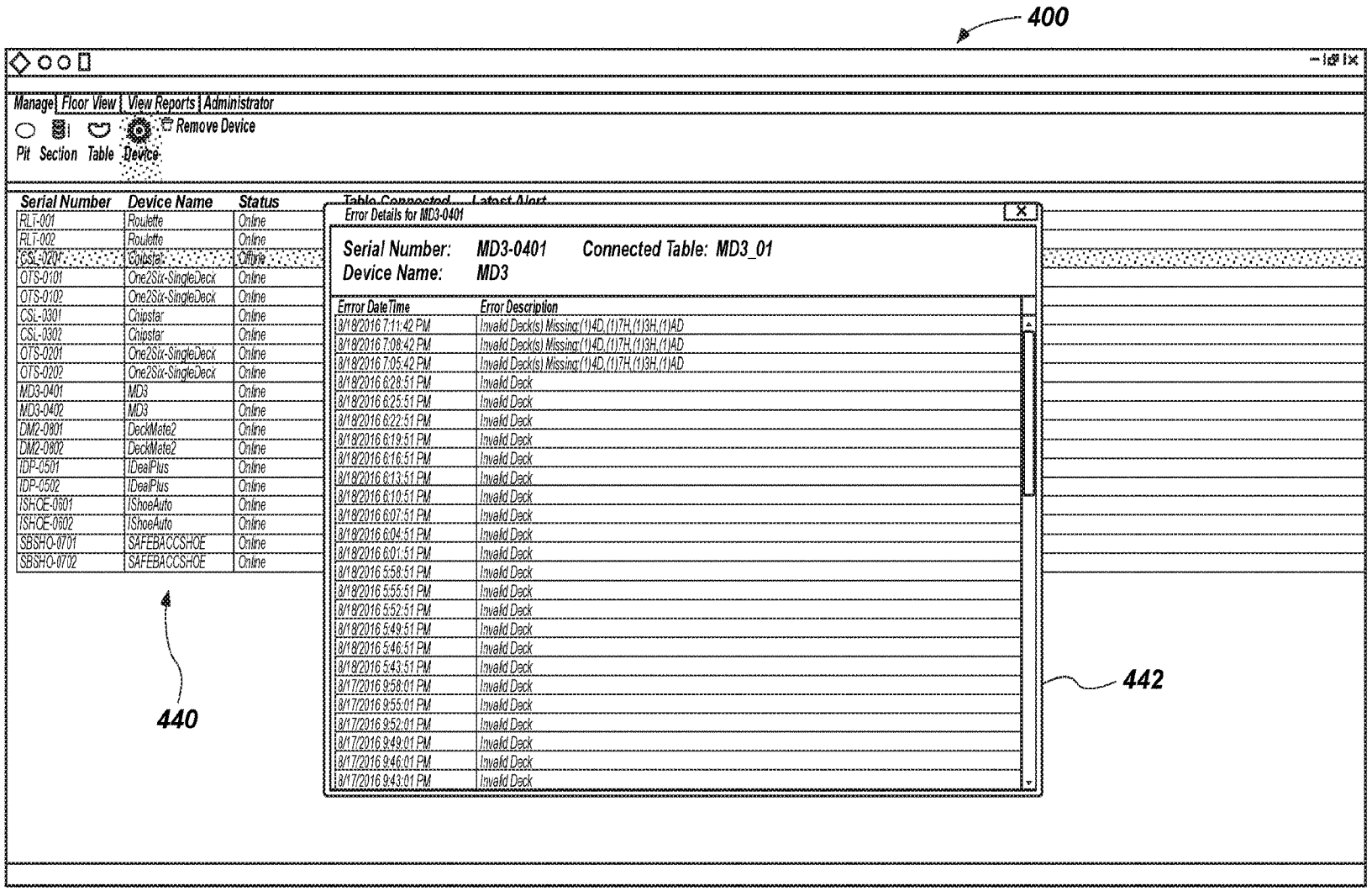

Referring specifically to FIG. 4C, the graphical user interface 400 may include a management portal in which the user may review entries 440 to identify the current status of the different casino gaming devices 110. For example, FIG. 4C shows a device-level listing of the different gaming devices 110 (e.g., identified by serial number) linked to the monitoring server 140. The different gaming devices 110 (e.g., a roulette wheel, a chip sorter, and various configurations of card shufflers and electronic shoes) may be viewable individually to see the status (e.g., online vs. offline), the table to which the device is connected, as well as the most recent alert. The graphical user interface 400 may also provide the user with the option to view different levels of listings (e.g., a table-level listing, a section-level listing, and also a pit-level listing of different devices) that are linked to the monitoring server. Referring specifically to FIG. 4D, a new window 442 may be opened responsive to the user selecting one of the entries to view an expanded list of prior alerts for a specific gaming device 110.

Figure 4E:
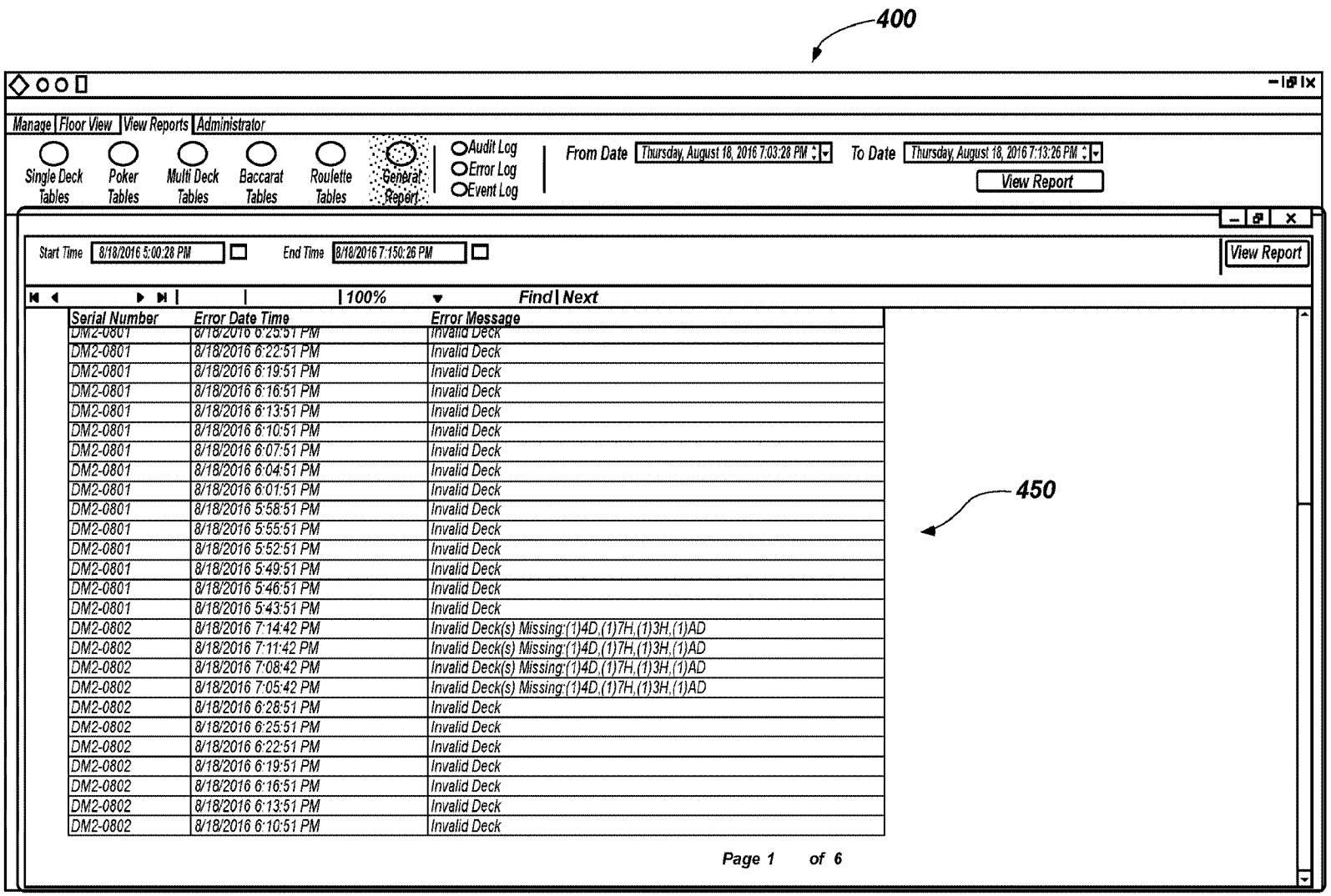

Referring specifically to FIG. 4E, the graphical user interface 400 may include a report portal in which the user may generate reports 450 for the different gaming devices 110 linked to the monitoring server 140. The reports may be sorted as a general report (e.g., all devices) or filtered according to individual device types (e.g., single deck tables, multi-deck tables, baccarat tables, roulette tables, etc.).

Figure 4F:
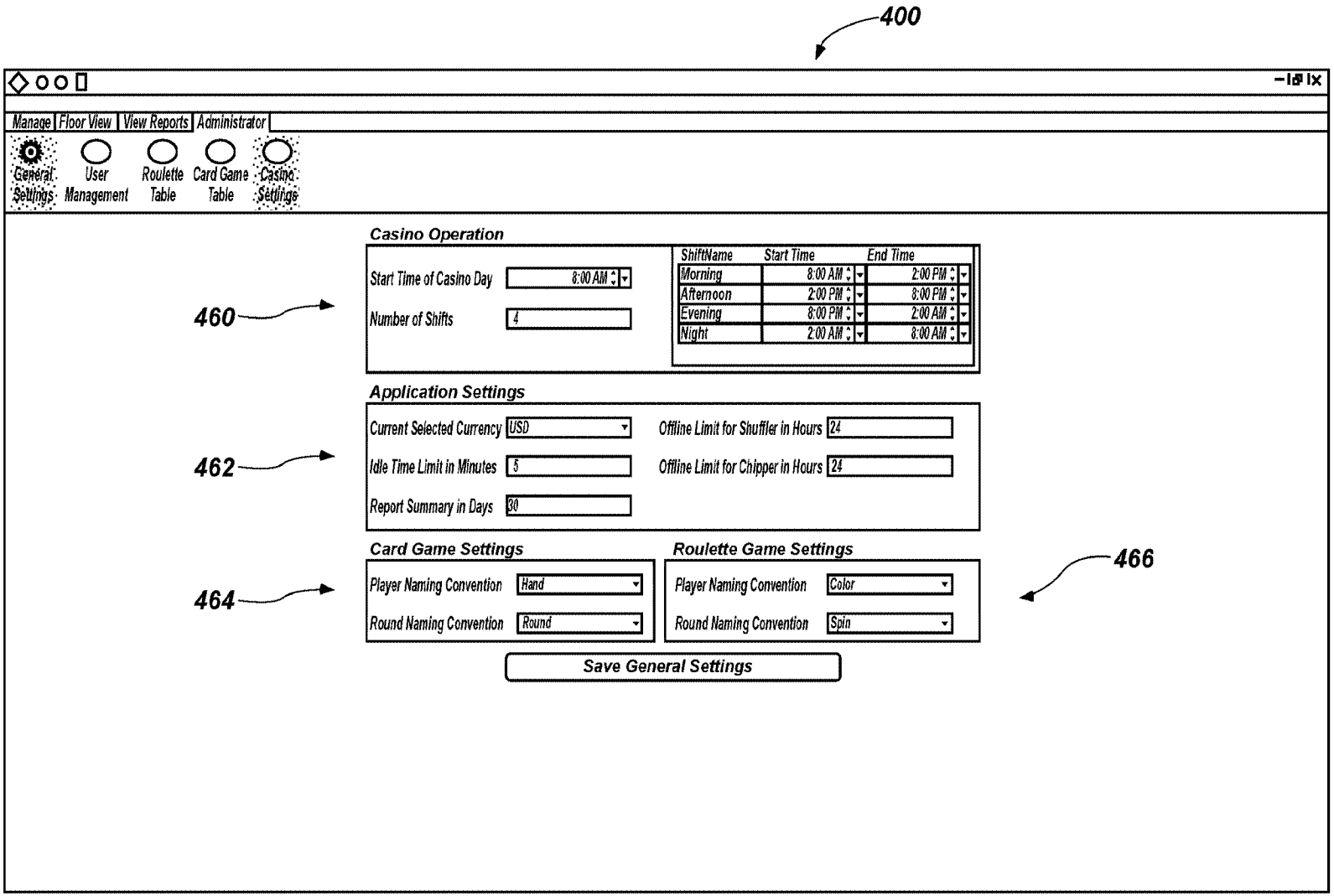
Figure 4G:
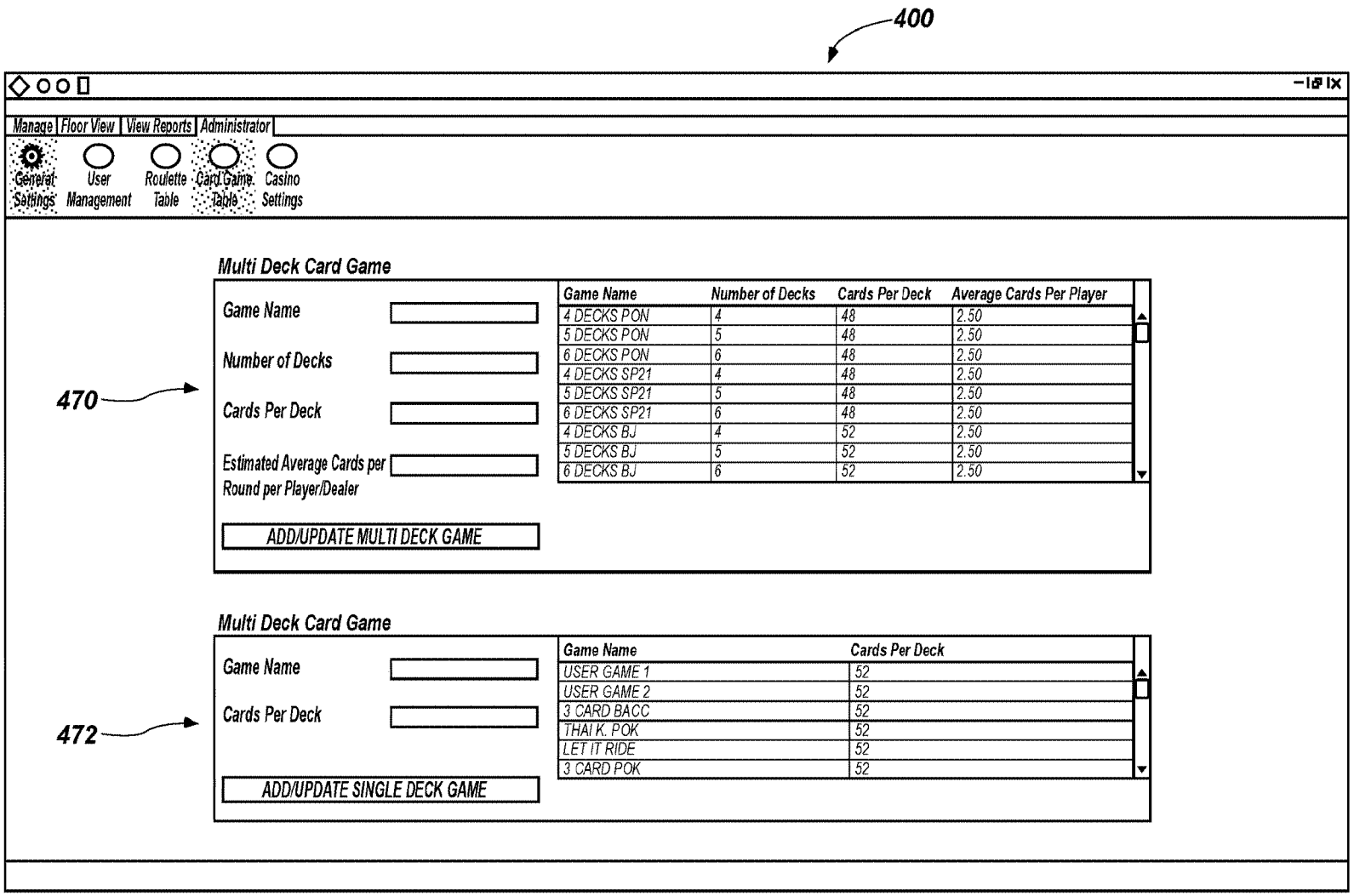
Figure 4H:
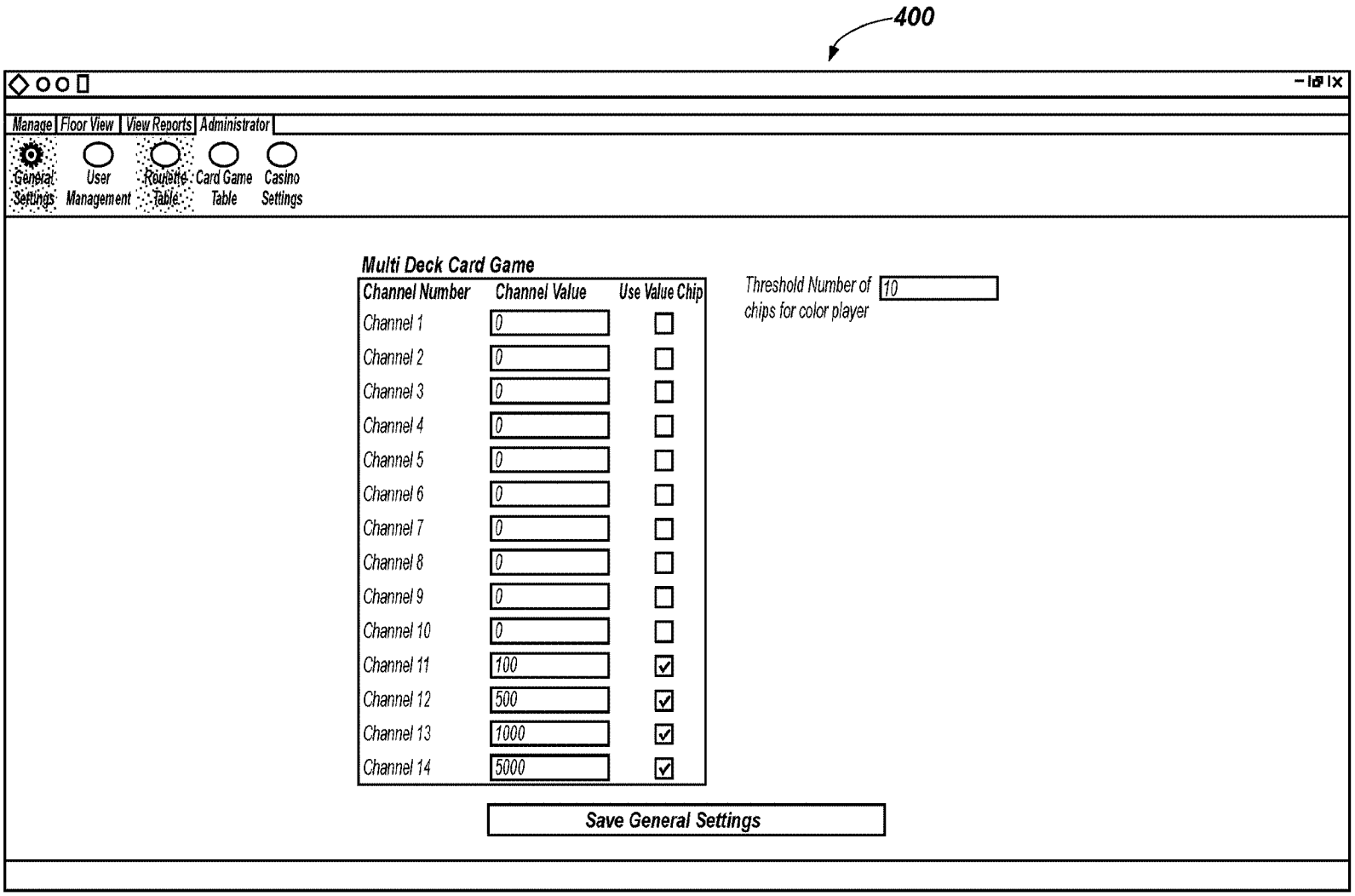

Referring specifically to FIGS. 4F-4H, the graphical user interface 400 may further include an administrator portal in which the user may manage various administrative features of the system. For example, as shown in FIG. 4F, the user may manage general settings for the network such as defining monitoring shifts 460 (e.g., start and end times, number of shifts monitored, etc.), application settings 462 (e.g., wager currency, time limits for generating off line reports, etc.), card game settings 464 (e.g., player and round naming conventions for reports), and roulette game settings 466 (e.g., player and round naming conventions for reports). In FIG. 4G, the administrator may manage different card game tables by naming new card game tables according to either a multi deck card game 470 or a single deck card game 472 as well as entering other information, such as the name of the game, the number of decks, the number of cards per deck, and an estimated average cards per round per player or dealer. In FIG. 4H, the administrator may manage different roulette tables by assigning different chip values permitted to be used by the a chip sorting device assigned to the roulette table.

Figure 5A:
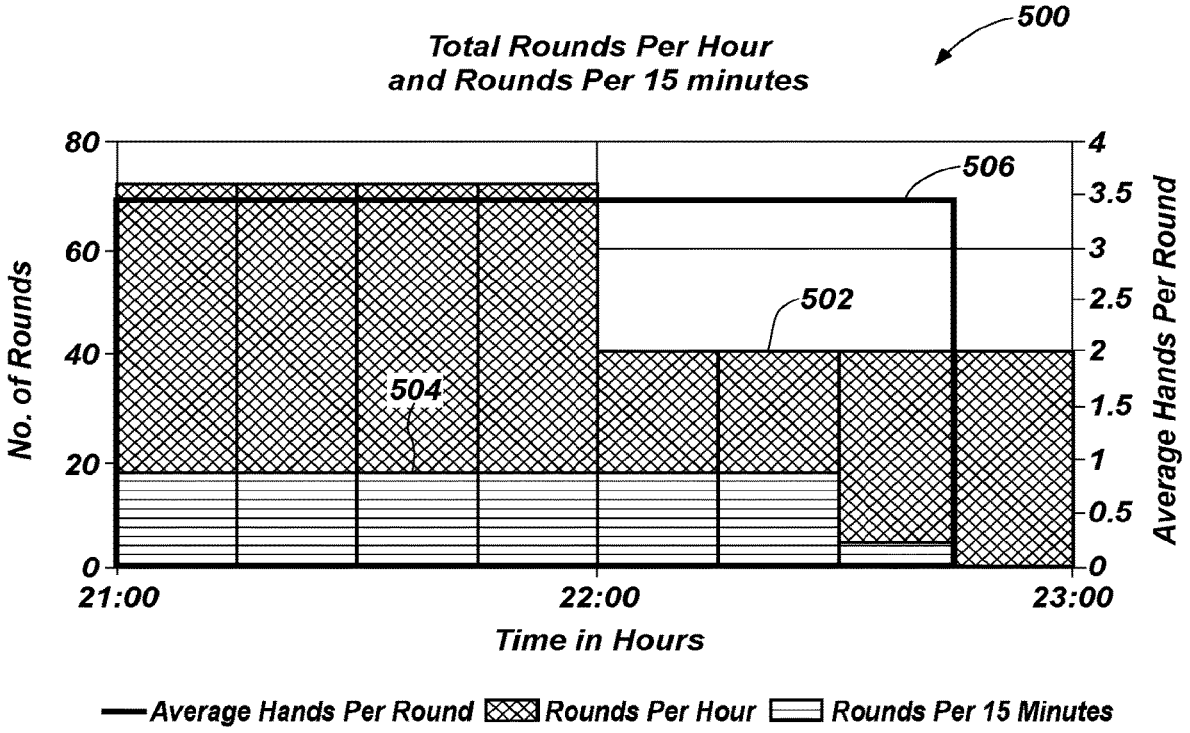
FIGS. 5A-5C are graphs of various representative off line reports that may be generated using game data from card handling devices.
Figure 5B:
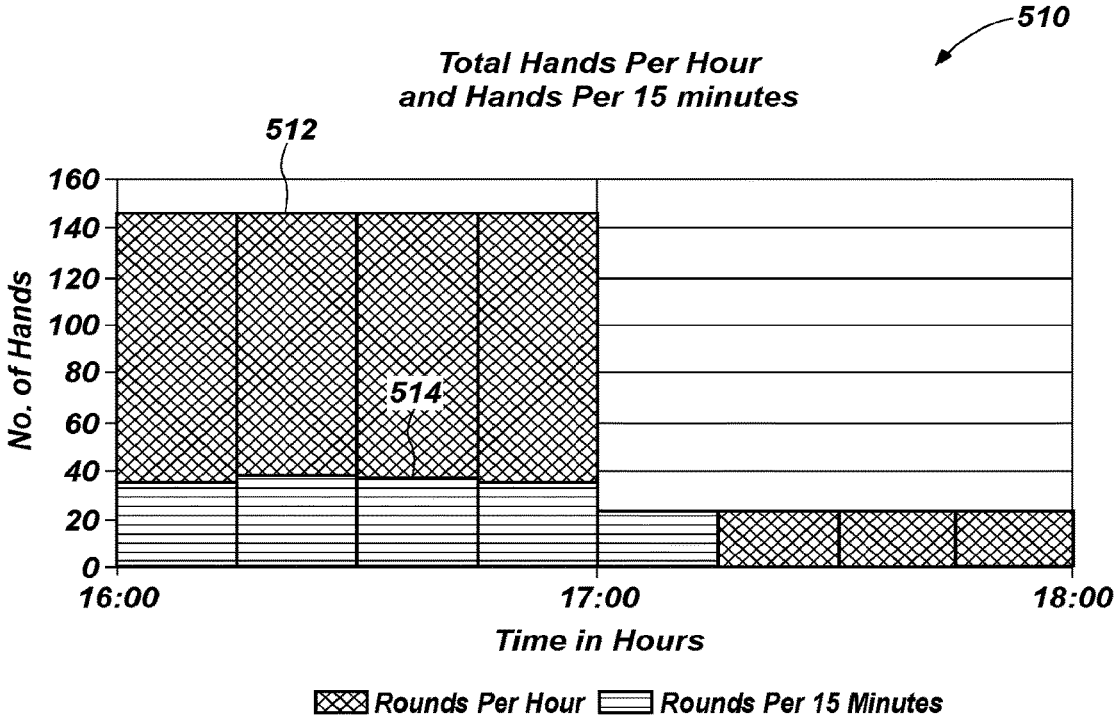
Figure 5C:
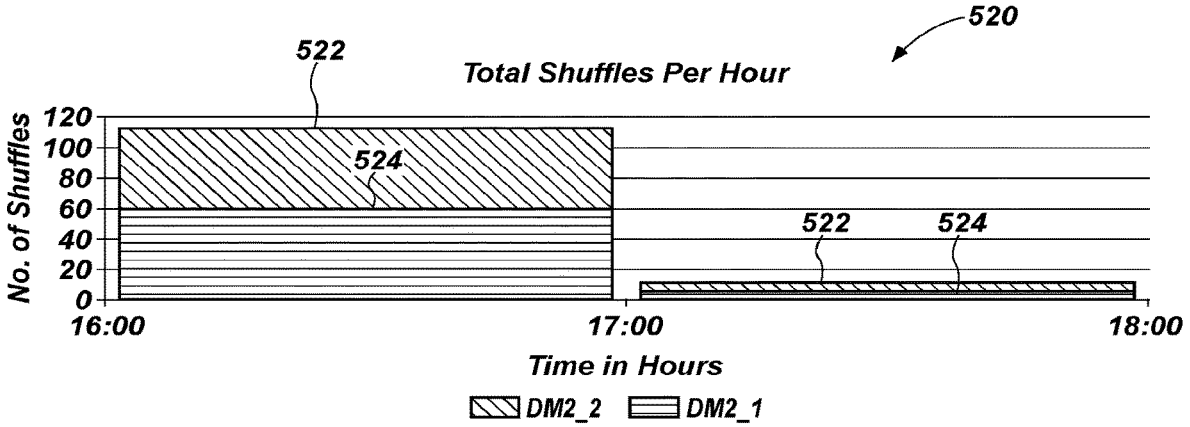

FIGS. 5A-5C are graphs 500-520 of various representative off line reports that may be generated using game data from card handling devices. FIGS. 6A-6D are graphs 600-630 of various representative off line reports that may be generated using game data from roulette tables. Such off line reports may be defined over a desired interval selected by the user. In some embodiments, the user may set up automatic reports to be generated according to a defined schedule (e.g., daily, weekly, etc.).

Referring specifically to FIG. 5A (graph 500), the total rounds per hour from a card handling device 110 may be displayed using bars 502 as compared with the total number of rounds per 15 minutes using bars 504. In addition, line 506 is overlaid onto graph 500 showing the average number of hands per round. Referring specifically to FIG. 5B (graph 510), the total hands per hour from a card handling device 110 are displayed using bars 512 as compared with the total number of hands per 15 minutes using bars 514. Generating such reports using other metrics (e.g., total number of shuffles, total number of cards dealt, etc.) are also contemplated.

Referring specifically to FIG. 5C (graph 520), game data from multiple different card handling devices 110 may be compared in the same report. For example, the total number of shuffles per hour of a first card handling device 110 may be displayed using bars 522 in comparison to the total number of shuffles per hour of a second card handling device 110 displayed using bars 524. Of course, other metrics (e.g., total rounds, total cards dealt, total hands, etc.) are also contemplated for such reports of comparing game data between multiple gaming devices 110 over the same time interval.

Figure 6A:
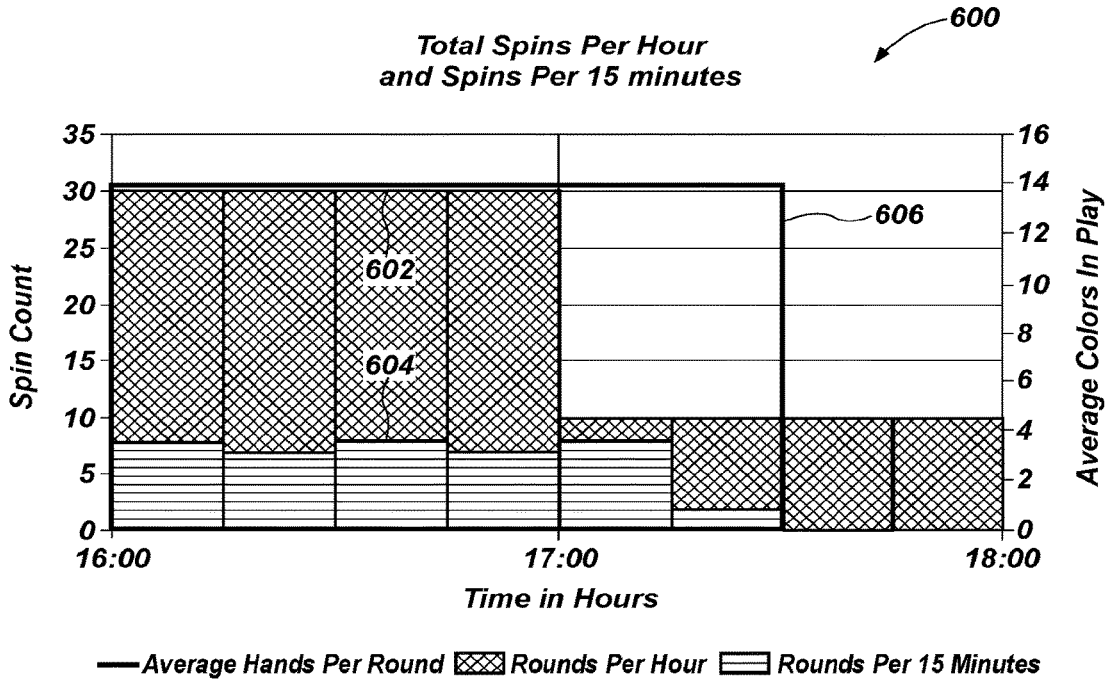
FIGS. 6A-6D are graphs of various representative off line reports that may be generated using game data from roulette tables.
Figure 6B:
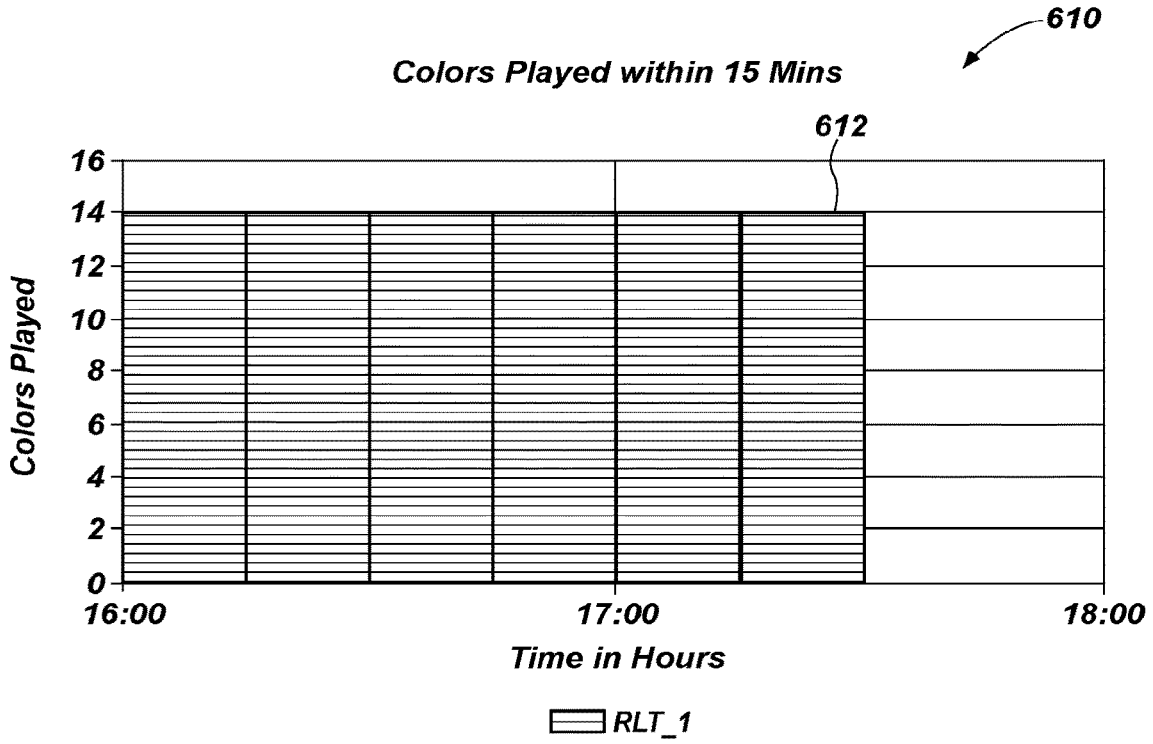
Figure 6C:
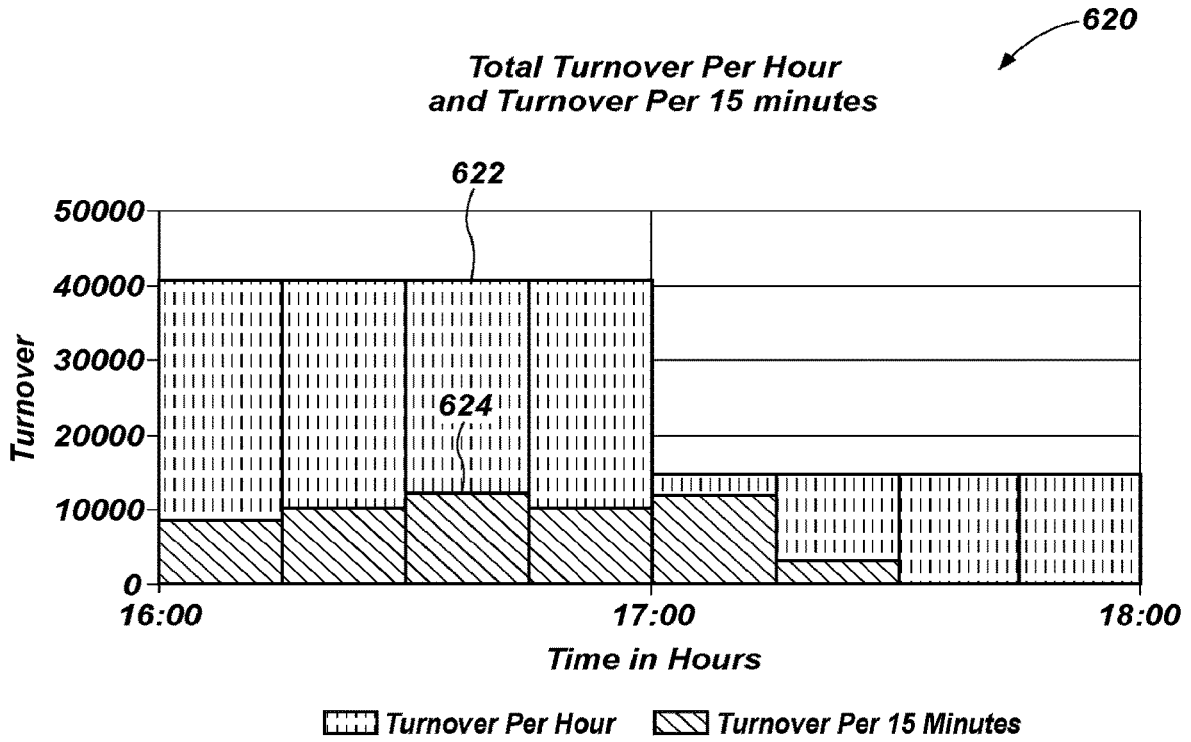

Referring specifically to FIG. 6A (graph 600), total spins per hour from a roulette table may be displayed using bars 602 as compared with the total number of spins per 15 minutes using bars 604. In addition, line 606 is overlaid onto graph 600 showing the average number of colors (i.e., players) per play. Referring specifically to FIG. 6B (graph 610), the total colors (i.e., players) per 15 minutes from a roulette table are displayed using bars 612. Referring specifically to FIG. 6C (graph 620), total turnover (i.e., revenue) per hour from a roulette table may be displayed using bars 622 as compared with the total number of turnover per 15 minutes using bars 624.

Figure 6D:
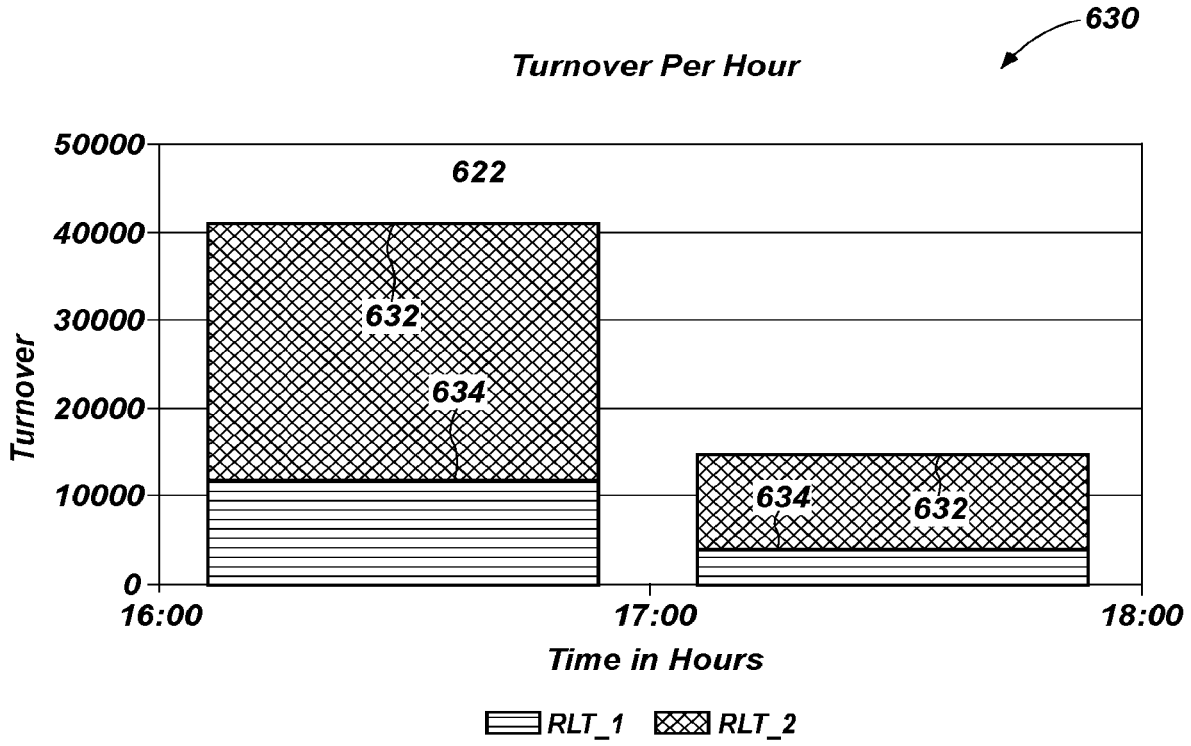

Referring specifically to FIG. 6D (graph 630), game data from multiple different roulette tables may be compared in the same report. For example, the total turnover per hour of a first roulette table may be displayed using bars 632 in comparison to the total turnover per hour of a second roulette table displayed using bars 634. Of course, other metrics (e.g., total colors, total spins, etc.) are also contemplated for such reports of comparing game data between multiple roulette tables over the same time interval.

Specific embodiments have been shown by way of example in the drawings and have been described in detail herein; however, the invention may be susceptible to various modifications and alternative forms. It should be understood that the invention is not limited to the particular forms disclosed. Rather, the invention includes all modifications, equivalents, derivatives and alternatives within the scope of the invention as defined by the following appended claims and legal equivalents.

What is claimed is:

1. A monitoring system, comprising:

a monitoring server configured to:

receive performance data from a number of electronic card handling devices in real-time during operation thereof, the performance data selected from the group consisting of one or more of shuffling data, game hand data, card dealing/distribution data, game round data, and game outcome data;

associate each electronic card handling device's received performance data with the corresponding electronic card handling device generating the performance data; and control a video display to display the performance data, the performance data including at least one report depicting a comparison of real-time operational data for at least two card handling devices of the number of electronic card handling devices.

2. The monitoring system of claim 1, further comprising the number of electronic card handling devices, each card handling device of the number of electronic card handling devices including a unique identifier and configured to generate the associated performance data.

3. The monitoring system of claim 2, wherein the monitoring server is further configured to receive the associated unique identifier from each card handling device of the number of electronic card handling devices.

4. The monitoring system of claim 3, wherein the monitoring server is further configured to identify the at least two card handling devices based on the unique identifiers associated with the at least two card handling devices.

5. The monitoring system of claim 1, wherein the monitoring server is further configured to control the video display to display at least one graphical representation of at least one of dealer performance data, player data, or wager data.

6. A method, comprising:

receiving, for each card handling device of a number of card handling devices coupled to a network, operational performance indicators of a respective card handling device;

generating a response data set including at least some of the operational performance indicators related to two or more card handling devices of the number of card handling devices; and displaying the response data set at one or more output devices coupled to the network, the response data set including a comparison of operational performance indicators of at least two card handling devices of the two or more card handling devices.

7. The method of claim 6, wherein displaying the response data set comprises displaying the response data set in real-time at the one or more output devices.

8. The method of claim 6, further comprising receiving an area identifier identifying an area including the respective card handling device.

9. The method of claim 8, further comprising receiving a user-selected area identifier and a user-selected device type.

10. The method of claim 9, wherein generating the response data set comprises generating the response data set including at least some of the operational performance indicators related to the two or more card handling devices of the user-selected device type and having an area identifier matching the user-selected area identifier.

11. The method of claim 9, wherein receiving the user-selected device type and the user-selected area identifier comprises receiving the user-selected device type and the user-selected area identifier from a user input device of an operator station.

12. The method of claim 11, wherein displaying the response data set comprises displaying the response data set via a display of the operator station.

13. The method of claim 11, further comprising receiving at least one user-defined setting from the user input device of the operator station, wherein generating the response data set comprises generating the response data set based at least partially on the at least one user-defined setting.

14. The method of claim 6, further comprising storing, at a server remote from the number of card handling devices, operational performance indicators of each card handling device of the number of card handling devices.

15. A monitoring system, comprising:

a number of casino table devices coupled to a network; and a monitoring server coupled to the network and configured to:

receive performance data from the number of casino table devices;

associate received performance data with a corresponding casino table device of the number of casino table devices; and display, via a graphical user interface, the performance data for at least two casino table devices of the number of casino table devices.

16. The monitoring system of claim 15, further comprising a service center coupled to the monitoring server via another network, the monitoring server configured to convey real-time alerts to the service center.

17. The monitoring system of claim 15, wherein the performance data includes at least one of shuffling data, game hand data, card dealing/distribution data, game round data, or game outcome data.

18. The monitoring system of claim 15, wherein the monitoring server is further configured to display, via the graphical user interface, aggregate data for at least some of the number of casino table devices.

19. The monitoring system of claim 15, wherein the monitoring server is configured to receive the performance data in real-time and display the performance data in real-time.

20. The monitoring system of claim 15, wherein the monitoring server is further configured to display real-time alerts via the graphical user interface.

* * * * *